US006715729B2

(12) United States Patent
Hambelton

(10) Patent No.: US 6,715,729 B2
(45) Date of Patent: Apr. 6, 2004

(54) OVERHANGING FORM SYSTEM AND METHOD OF USING THE SAME

(75) Inventor: John J. Hambelton, Denton, TX (US)

(73) Assignee: Symons Corporation, Des Plaines, IL (US)

( * ) Notice: Subject to any disclaimer, the term of this patent is extended or adjusted under 35 U.S.C. 154(b) by 298 days.

(21) Appl. No.: 09/784,396

(22) Filed: Feb. 15, 2001

(65) Prior Publication Data

US 2001/0037614 A1 Nov. 8, 2001

Related U.S. Application Data

(60) Provisional application No. 60/183,399, filed on Feb. 18, 2000.

(51) Int. Cl.[7] ..... E04G 5/06; E04G 11/00; E04G 17/16

(52) U.S. Cl. ..... 249/24; 249/23; 249/211; 248/228.1; 182/82

(58) Field of Search ..... 249/211, 219.1, 249/2, 19, 23, 24; 182/82

(56) References Cited

U.S. PATENT DOCUMENTS 3,119,590 A * 1/1964 Eriksson
3,755,983 A * 9/1973 Beckham
3,782,676 A * 1/1974 Boll et al.
3,806,074 A * 4/1974 Ward
4,846,433 A * 7/1989 Courtois et al.
4,893,363 A * 1/1990 Huff
5,083,739 A 1/1992 Shook et al.
5,104,089 A 4/1992 Shook et al.
5,755,981 A 5/1998 Payne
5,865,410 A * 2/1999 Horene
6,155,649 A * 12/2000 Sessler et al.

FOREIGN PATENT DOCUMENTS

FR 2610027 * 6/1988

OTHER PUBLICATIONS

PCT International Search Report, dated Jun. 11, 2001, PCT Appl. No. PCT/US 01/05201.

* cited by examiner

*Primary Examiner*—Robert Canfield
(74) *Attorney, Agent, or Firm*—Thomas W. Flynn; Wood, Herron & Evans, LLP

(57) ABSTRACT

An overhanging form system for attachment to a support structure is disclosed. The support structure includes an upper portion and a lower portion, and the overhanging form system comprises a pair of spaced apart hangers, with each of the hangers being adapted to engage the upper portion of the support structure. A pair of frames are provided, with each of the frames having a first portion and a second portion. The first portion of each frame engages a corresponding one of the hangers, the second portion of each frame is adapted to engage the lower portion of the support structure. Each of the frames further includes a first leg and a second leg, with the first leg having an inner end disposed adjacent the first portion of the frame and an outer end disposed outwardly from the first portion of the frame. The second leg extends from the second portion of the frame to engage the outer end of the first leg. A plurality of stiffeners are provided. Therefore, the overhanging form system may lifted as a single unit and attached to the support structure in cantilevered fashion.

35 Claims, 22 Drawing Sheets

OVERHANGING FORM SYSTEM AND METHOD OF USING THE SAME

RELATED APPLICATIONS

This application claims priority from earlier filed U.S. Provisional Application Ser. No. 60/183,399, filed Feb. 18, 2000.

FIELD OF THE INVENTION

The present invention relates generally to systems for forming concrete structures. More specifically, the present invention relates to an all steel overhang system for use when forming an overhanging portion of a concrete structure, such as a portion of a bridge deck or a floor, and that protrudes in cantilever fashion from a supporting structure.

BACKGROUND OF THE INVENTION

In concrete construction modular forming systems for forming concrete walls are generally well known in the art. Modular forming systems for concrete walls are generally favored by contractors because such modular systems permit the rapid assembly, disassembly, and reuse of the forms, thus offering significant savings in terms of time, labor, and materials. Moreover, the use of a discrete number of pre-manufactured wall form sections permits the construction of wall having different height, length, and thickness simply by choosing modular sections of the desired size.

When constructing bridges having concrete bridge decks, frequently a portion of the bridge deck will be constructed so as to extend outwardly from the outermost beam or girder in cantilever fashion. Of course this overhanging or cantilevered portion of the bridge deck must be properly supported from below by formwork so as to support the uncured concrete.

Typically, the temporary support of uncured concrete is achieved by first individually constructing a number of cantilevered support members. These cantilevered support members are then attached to the outermost beam or girder in outwardly extending fashion. Next, a number of longitudinal supports, most typically wooden members, are placed across the cantilevered supports in a direction parallel to the beam or girder. The formwork is then constructed on top of the wooden members.

After the concrete has been poured and is adequately cured, the form system and the supporting members are disassembled one-by-one. Such a conventional approach is very labor intensive, time consuming, and expensive both before and after the concrete has been poured.

It would be desirable to extend the cost savings afforded by modular construction of wall forms to the modular construction of overhang supports systems. Preferably, such a modular or ganged overhang forming system would permit the placement and/or removal of the system in discrete segments, such as by using a crane. Such modular or ganged construction of concrete overhangs would greatly improve the efficiencies associated with the construction of such overhang systems.

SUMMARY OF THE INVENTION

A ganged overhang form system constructed in accordance with the teachings of the present invention permits the placement and removal of overhang forms in ganged or modular sections. In the disclosed embodiment, such sections may be, for example, up to twenty four feet (24') in length. Longer and shorter sections may be contemplated. In the disclosed embodiment, each section may typically include a pair of frames, each of which may be secured by a hanger to a support structure, such as a bridge girder on a bridge under construction. The section will include a form panel already in place and spanning the distance between the frames. Each section may further include, by way of example and not limitation, at least one of the following: 1) edge forms, with or without optional plates for forming drip strips in the edge of the concrete; 2) guardrail attachments; 3) cross-bracing; and/or 4) supporting legs. Once the ganged form sections are assembled, the sections may be placed and removed using a "C" hook without disassembly, thus offering tremendous cost savings compared to more conventional approaches.

DETAILED DESCRIPTION OF THE PREFERRED EMBODIMENT

The following description of the disclosed embodiment is not intended to limit the scope of the invention to the precise form or forms detailed herein. Instead, the following description is intended to be illustrative of the principles of the invention so that others may follow its teachings.

Figure 1:
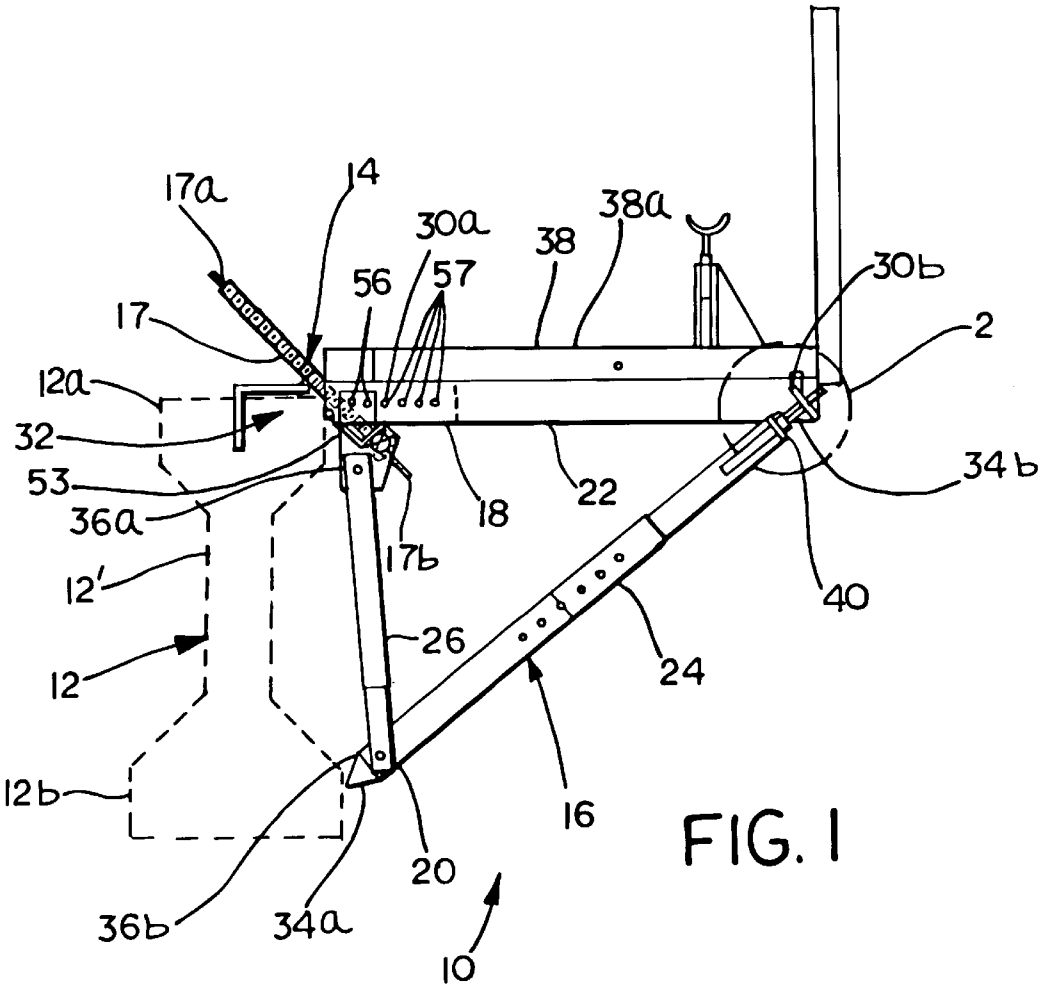
FIG. 1 is an end elevational view of an overhang form section assembled in accordance with the teachings of the present invention with the view being taken through a longitudinally extending concrete bridge girder shown in cross-section.
Figure 14:
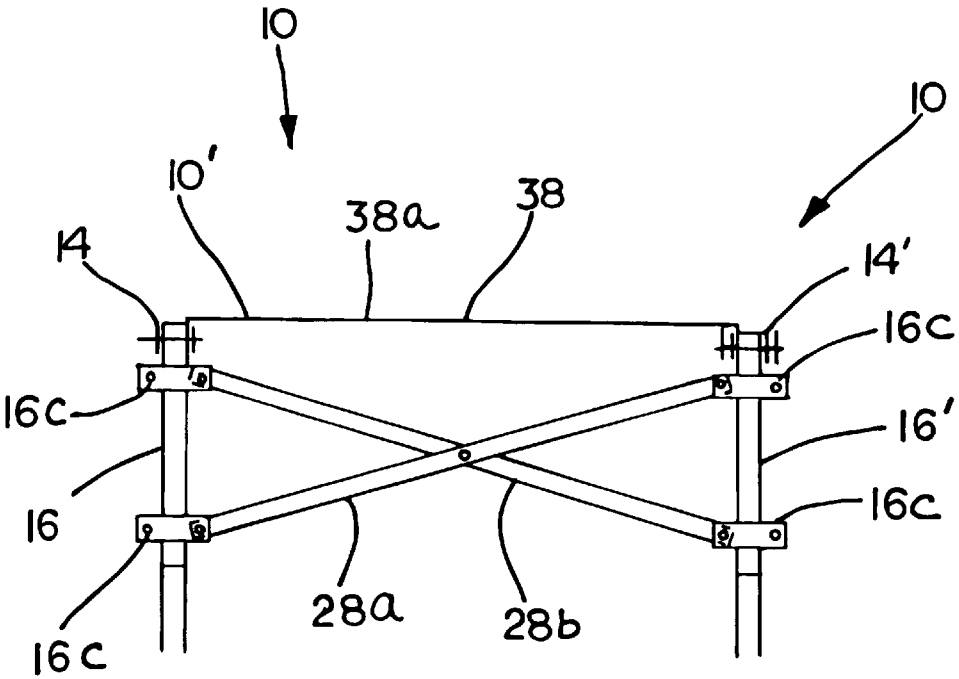
FIG. 14 is a fragmentary elevational view illustrating cross bracing extending between adjacent frames.
Figure 10:
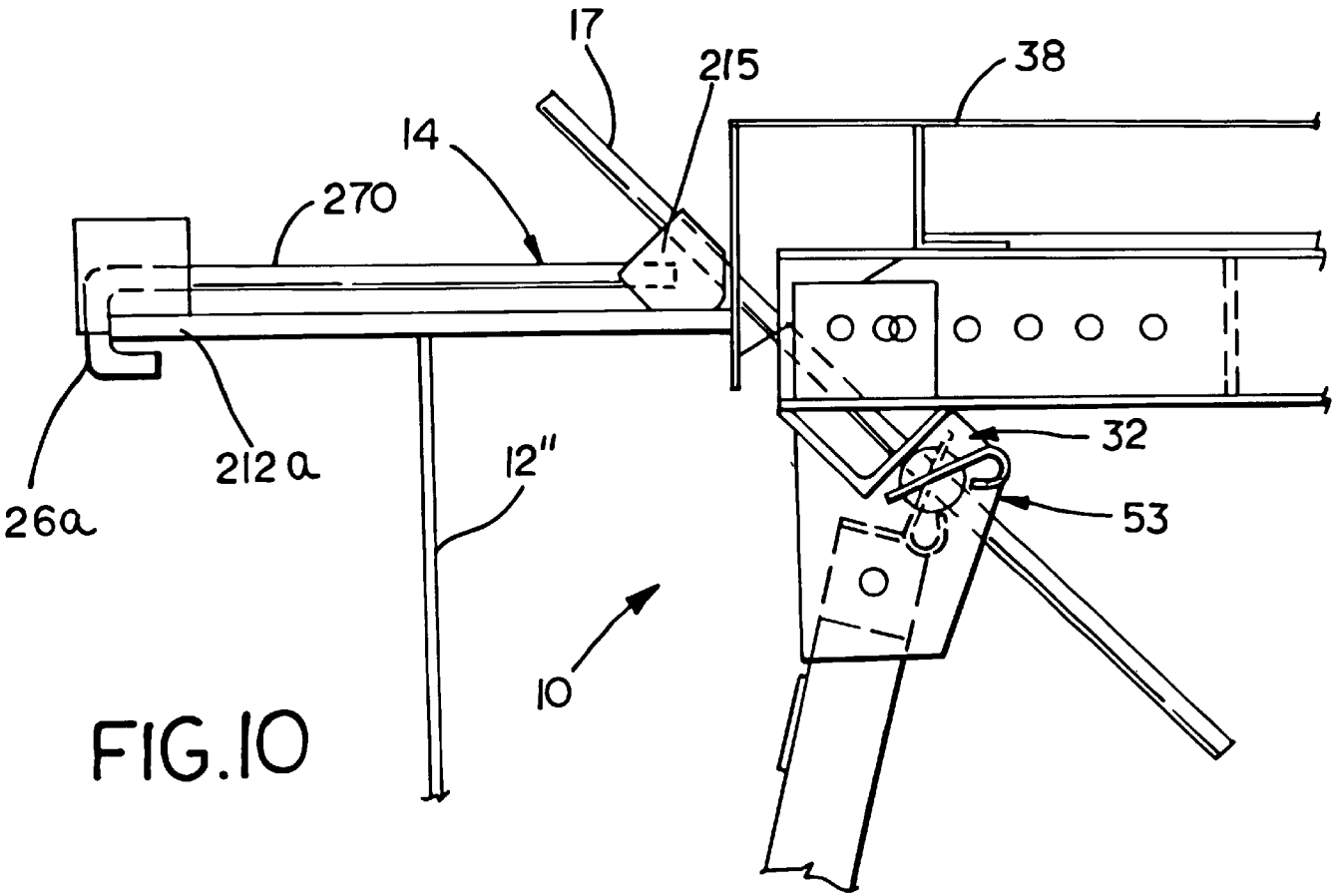
FIG. 10 is an end elevational view of an overhanging form section similar to that shown in FIG. 1, but illustrating the overhanging form system attached to a longitudinally extending steel bridge girder shown in cross-section.
Figure 11:
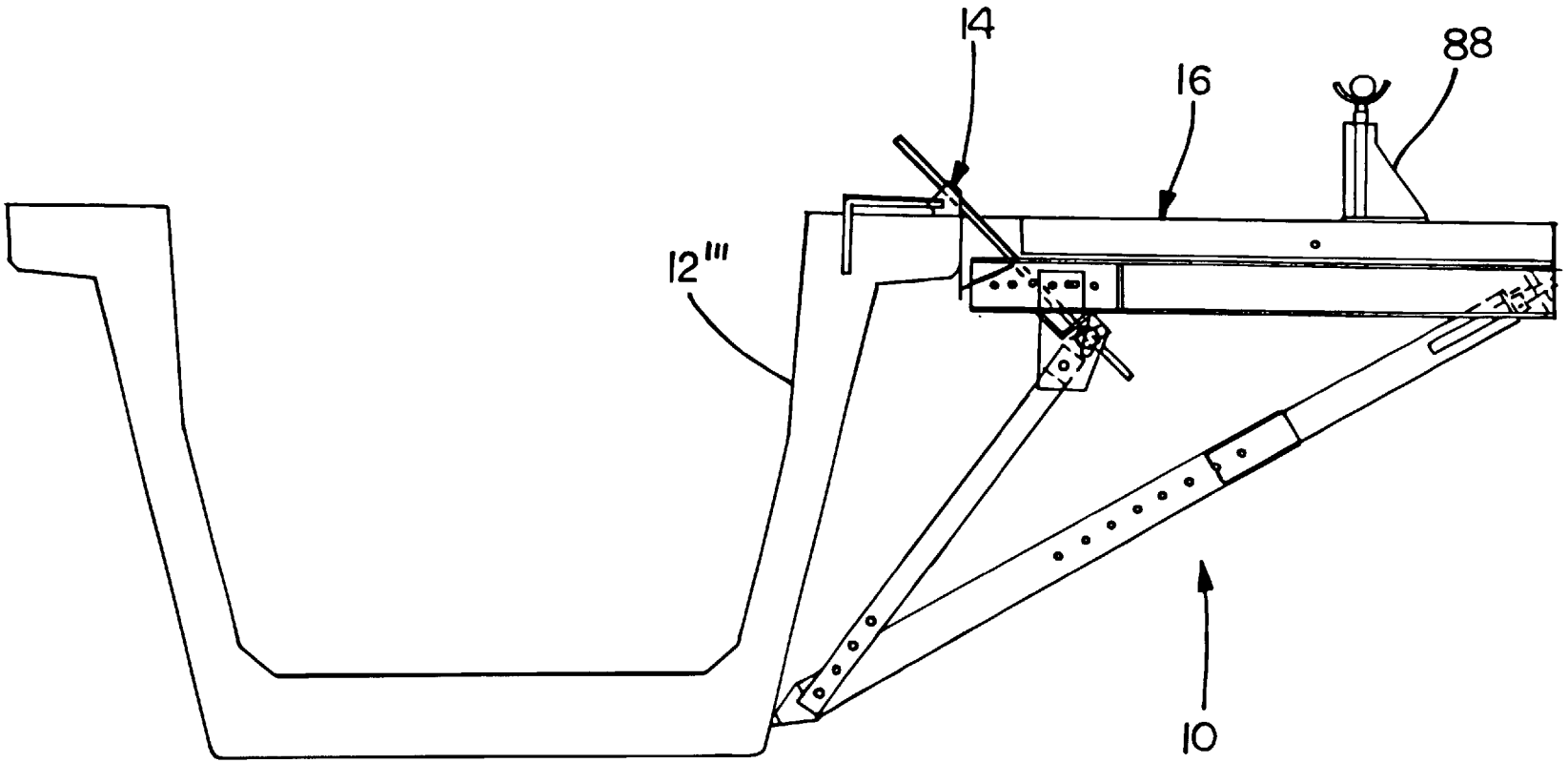
FIG. 11 is an end elevational view of an overhanging form section similar to that shown in FIG. 1, but illustrating the overhanging form system attached to another form of a concrete bridge girder.
Figure 15:
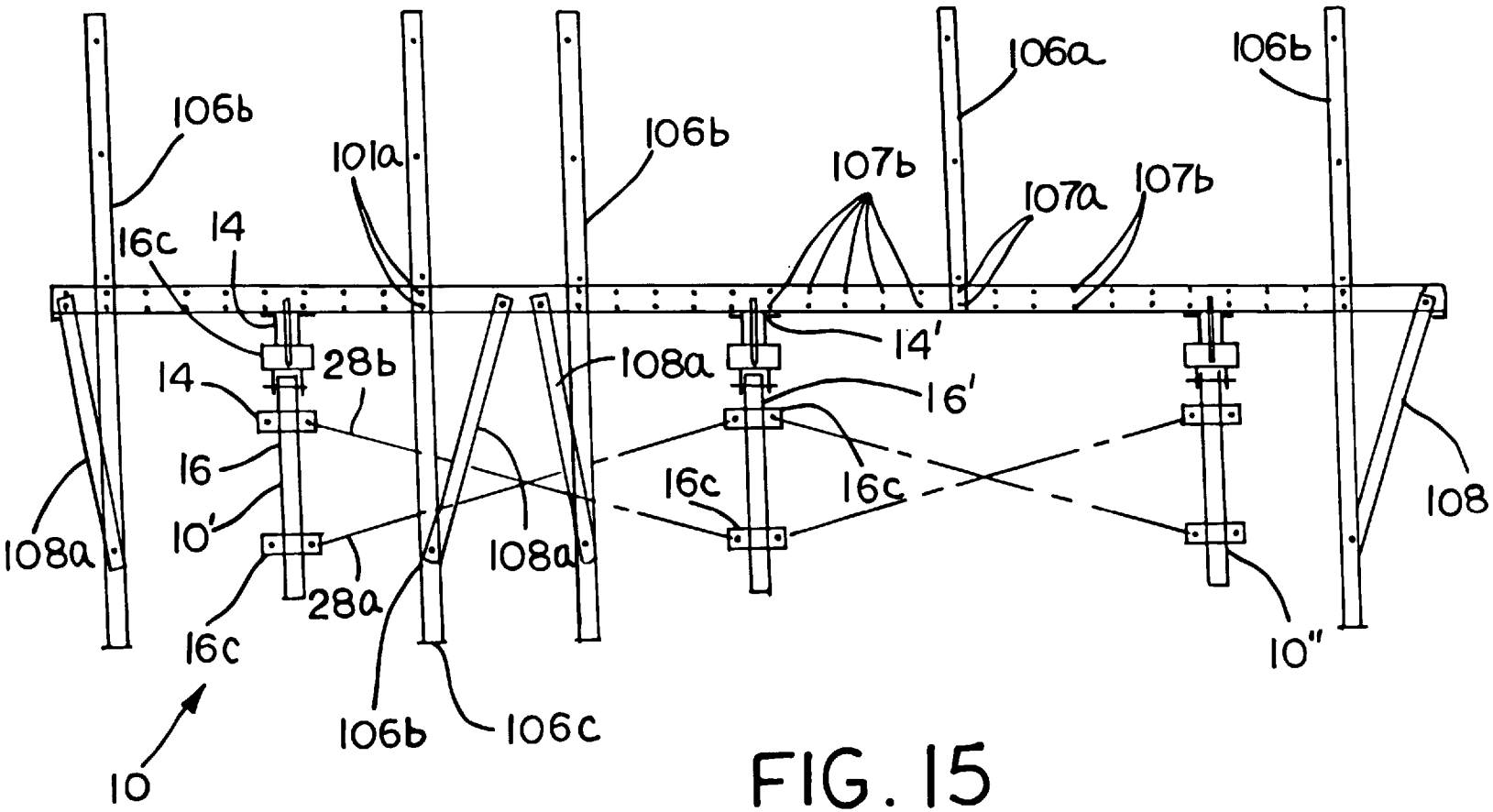
FIG. 15 is another fragmentary elevational view but illustrating cross braced guard rail supports as well as cross bracing between adjacent frames.
Figure 19:
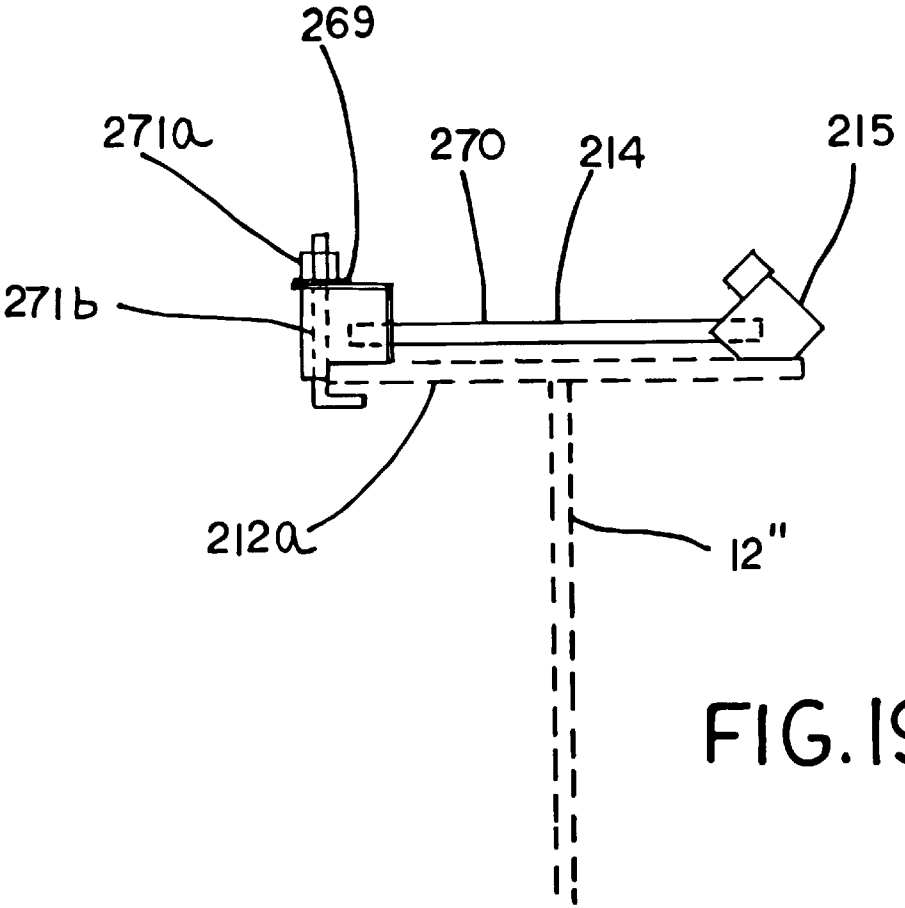
FIG. 19 is an enlarged fragmentary elevational view similar to FIG. 10 and illustrating an alternate detail for attachment of the hanger to the top flange of the steel bridge girder.
Figure 20:
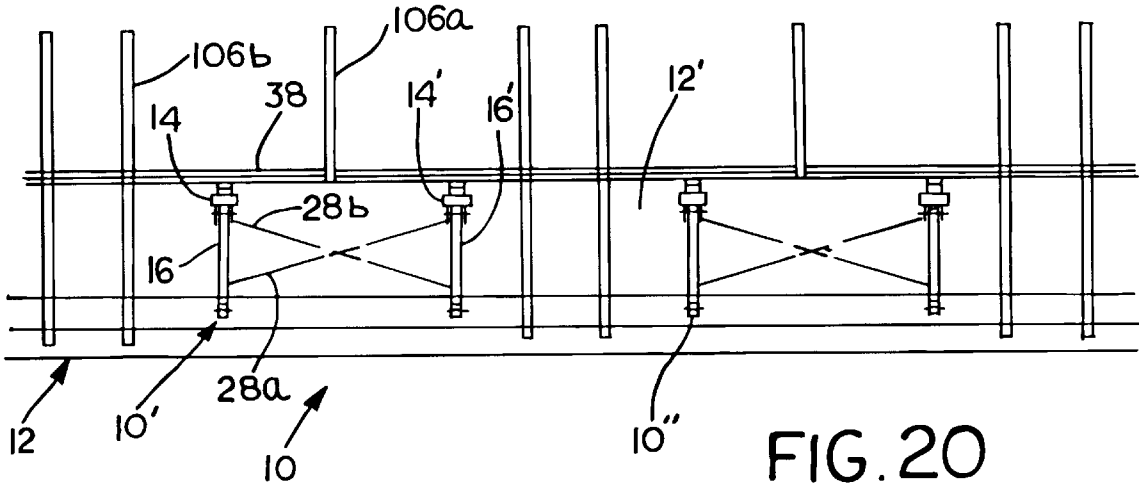
FIG. 20 is a side elevational view of an overhanging concrete form system assembled in accordance with the teachings of the present invention and including cross bracing and guardrail supports attached thereto, with at least some of the guard rail supports extending downwardly to a point roughly level with a lower portion of the frame sections.

Referring now to FIG. 1 of the drawings, an overhanging form system assembled in accordance with the teachings of the present invention is generally referred to by the reference numeral 10. The overhanging form system 10 is shown attached to a support structure 12, which extends longitudinally into and out of the plane of the drawing. In the first disclosed embodiment it will be understood that the support structure 12 takes the form of a concrete bridge girder 12' (the concrete bridge girder 12' is shown in FIGS. 1 and 16–18, while another such concrete bridge girder 12''' is shown in FIG. 11), or, alternatively, the support structure 12 may take the form of a steel bridge girder 12'' (such as is shown in FIGS. 10 and 19). The teachings of the disclosed invention may be equally applicable to other forms of support structures. Further, as shown in FIGS. 14, 15 and 20, it will be appreciated that the overhanging form system 10 will comprise a number of interconnected form sections 10', 10'', etc. Only a single form section 10' will be described herein in detail. The form section 10' includes a pair of spaced apart hangers 14, 14' and a pair of spaced apart frames 16, 16', with an interconnecting panel 38 spanning the distance therebetween. For the sake of brevity, only a single one of the hangers 14 and the frames 16 will described in detail herein. However, it will be understood that the hanger 14' is substantially similar to the hanger 14 and the frame 16' is substantially similar to the frame 16.

Referring again to FIG. 1, the frame 16 is shown connected to the hanger 14. The frame 16 includes an upper portion 18 supported by the hanger 14 generally adjacent to an upper portion 12*a* of the girder 12', and further includes a lower portion 20 which abuts a lower portion 12*b* of the girder 12'. In the disclosed embodiment, the frame 16 is formed by an upper leg 22, a diagonal leg 24, and a bracing leg 26. In the disclosed embodiment, the upper portion 18 of the frame 16 is defined by the upper leg 22 and the lower portion 20 of the frame 16 is defined by the diagonal leg 24.

The upper leg 22 includes an inner end 30*a* and an outer end 30*b*. The inner end 30*a* is secured to the hanger 14 at the upper portion 12*a* of the girder 12' by an adjustable connection 32. The diagonal leg 24 includes an inner end 34*a* and an outer end 34*b* which is connected to the upper leg 22 generally adjacent to the outer end 30*b* of the upper leg 22. The brace leg 24 includes an upper end 36*a* connected to the upper leg 22 generally adjacent to the inner end 30*a*, and a lower end 36*b* connected to the diagonal leg 24 generally adjacent to the inner end 34*a*. As shown in FIGS. 1, 14 and 15, a panel 38 extends between the frames 16 and 16'. The panel 38 defines a support surface 38*a* for supporting poured concrete (not shown). As shown in FIGS. 14 and 15, a pair of stiffeners 28*a* and 28*b* extend between the frame 16 and the frame 16'. In the disclosed embodiment, the stiffeners 28*a*, 28*b* are attached to the leg 26 on each of the frames 16, 16', such as by securing the stiffeners 28*a*, 28*b* to suitable mounting plates 16*c* (FIG. 14). Other suitable attachment points may be used.

Referring again to FIG. 1, in the disclosed embodiment the diagonal leg 24 and the brace leg 26 are preferably adjustable in length. This adjustability may be accomplished by constructing the legs 24, 26 out of telescoping tubular members of different cross sections, using shear pins or bolts to fix the length thereof. The diagonal leg 24 also includes an adjustable connection 40 at the outer end 34*b*. The upper end 36*a* of the brace leg 26 and the inner end 30 of the upper leg 22 are connected to a mounting bracket 53 which will be described in detail below.

Figure 4:
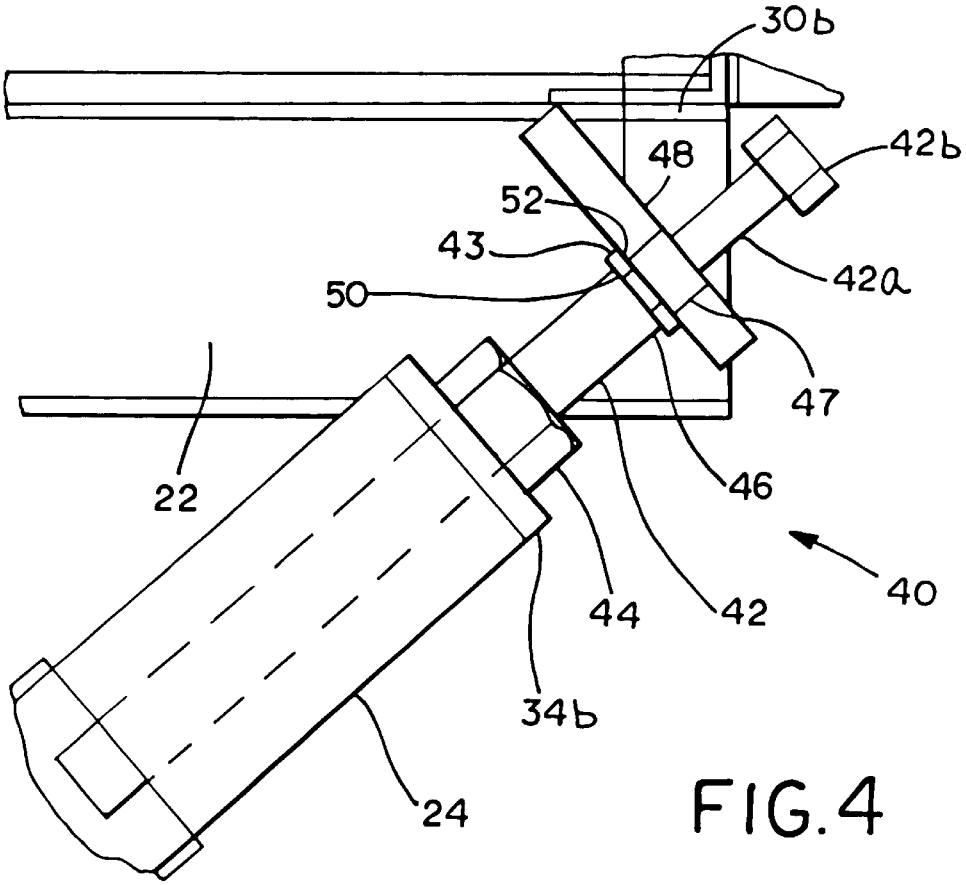
FIG. 4 is an enlarged fragmentary view taken about the circumscribed portion of FIG. 1 and illustrating an adjuster mechanism.

Referring to FIG. 4, in the disclosed embodiment the adjustable connection 40 includes a threaded rod 42 which engages a nut 44 secured to the outer end 34*b* of the diagonal leg 24, such as by welding. A bolt 42*b* is welded to an end 46 of the threaded rod 42. The bolt 42*b* extends through an aperture 47 in a diagonal plate 48 connected to the outer end 30*b* of the upper leg 22, with a shoulder 50 formed at the connection between the threaded rod 42 and the bolt 42*b* bearing against a surface 52 of the plate 48. Consequently, turning the head of the bolt 42*b* will serve to lengthen the overall length of the diagonal leg 24, thus altering the angle of the upper leg 22 relative to the horizontal. Alternatively, the threaded rod 42 maybe machined to form a narrowed portion 42*a* beginning at 46 and terminating in a hex head 42*b*. A washer 43 may be provided.

Figure 2:
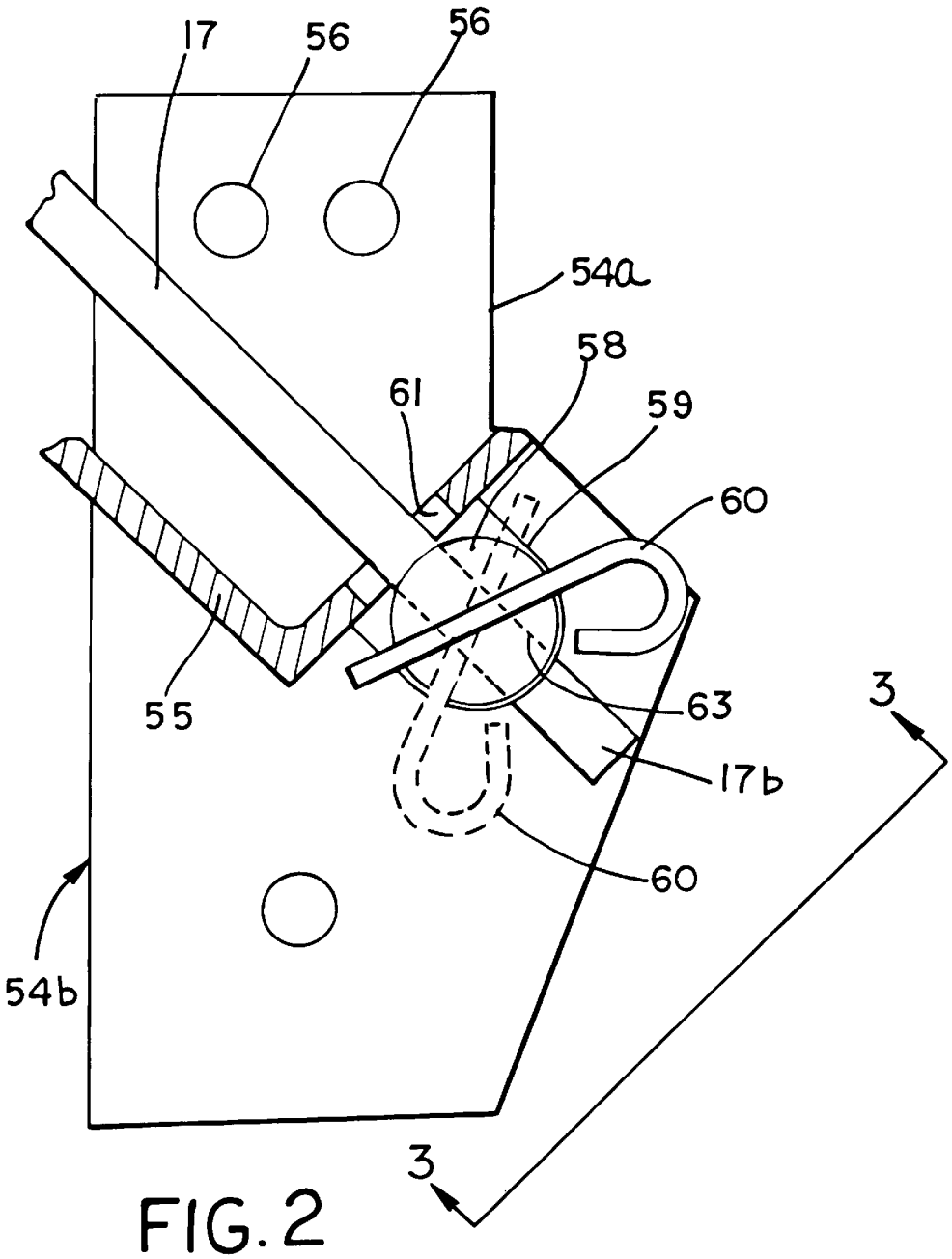
FIG. 2 is an enlarged elevational view taken about the circumscribed portion of FIG. 1 and illustrating certain details of the adjustable connection for use in joining the overhang form section to the bridge girder.
Figure 3:
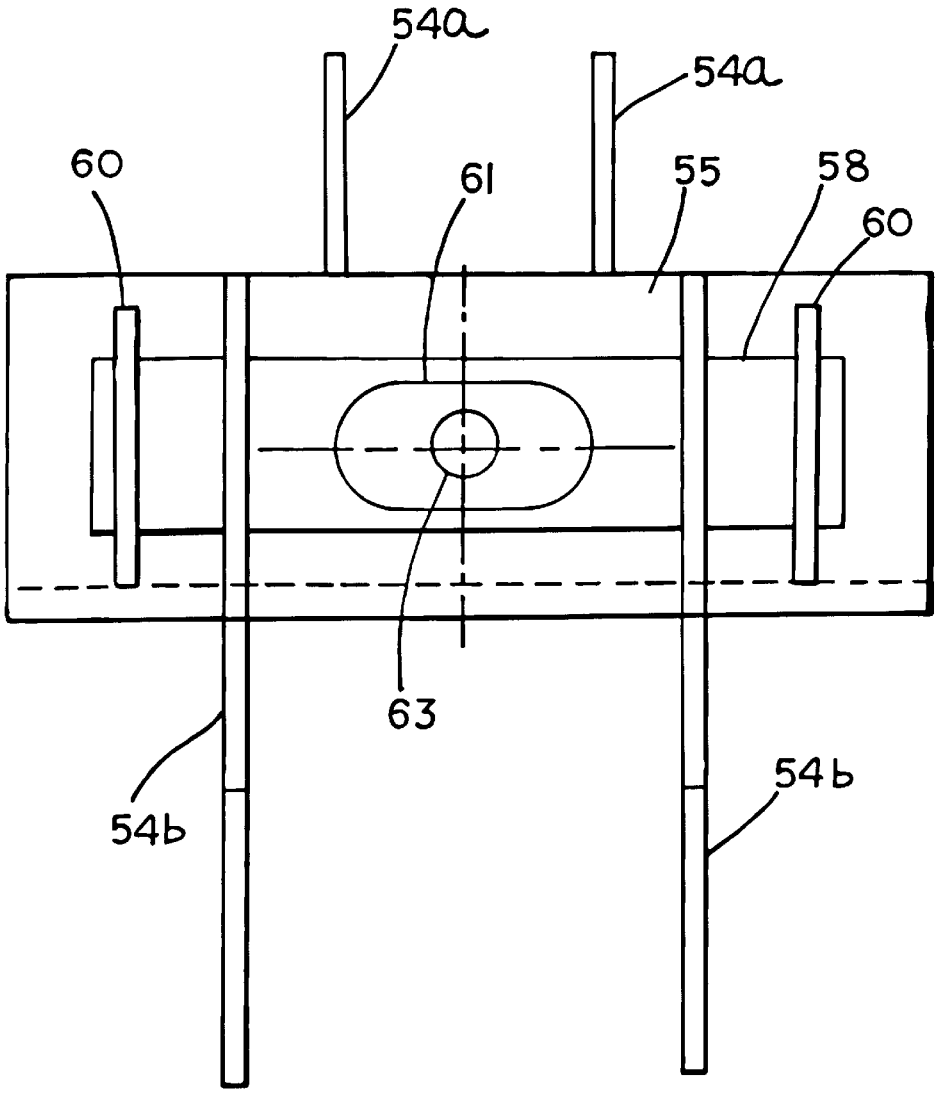
FIG. 3 is an elevational view of the adjustable connection taken along line 3—3 of FIG. 2.
Figure 5:
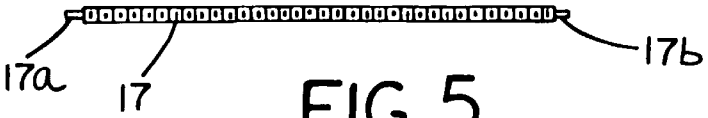
FIG. 5 is an enlarged view of the threaded rod for use with the adjustable connection of FIG. 2.

Referring now to FIGS. 2 and 3, in the disclosed embodiment the adjustable connection 32 includes the mounting bracket 53, which includes a pair of upper spaced apart plates 54*a* and a pair of lower spaced apart plates 54*b*. A plurality of connection holes 56 may be provided in the upper plates 54*a* (FIG. 2), and a plurality of connection holes 57 may be provided in the upper leg 22 (See for example, FIGS. 1 and 10), such that the point of connection between the upper leg 22 and the brace leg 26 may be varied. As will be explained below, the mounting bracket 53 is used to secure the frame 16 to the hanger 14 using an elongated threaded rod 17 (FIG. 1 and FIG. 5). The threaded rod 17 includes a pair of ends 17*a*, 17*b*, with preferably at least one the end 17*a* including a hex head such that the rod 17 is turnable using a wrench. The ends 17*a*, 17*b* may be machined to form the hex heads. The bracket 53 includes a cross member 55, with the upper plates 54*a* and the lower plates 54*b* mounted to the cross member 55. Each of the lower plates 54*b* includes an aperture 59, and a rod 58 is pivotally received in the apertures 59. The rod 58, which is preferably hardened steel and includes a tapped hole 63, is maintained in position between the lower plates 54 by a keeper pin 60 at each end. The cross member 55, which in the disclosed embodiment is an angled section, includes an elongated hole 61. The keeper pins 60 limit the rotation of the rod 58 within the apertures 59 by coming into contact with the cross member 55. Viewing FIG. 3, it will be noted that the keeper pins 60 are spaced away from the plates 54*b*, such that the rod 58 is moveable axially through the apertures 59 (i.e., to the left and right when viewing FIG. 3). The threaded rod 17 (shown in fragment in FIG. 2) engages the tapped hole 63 in the rod 58.

Figure 16:
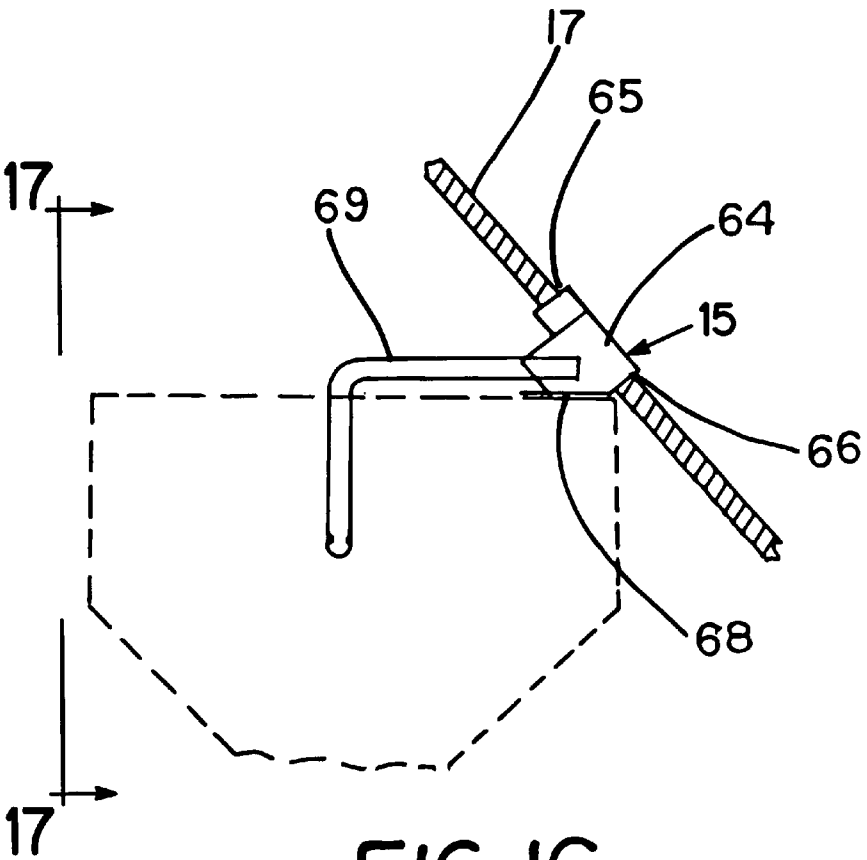
FIG. 16 is an enlarged fragmentary elevational view illustrating one component of the adjustable connection attached to the concrete bridge girder.
Figure 17:
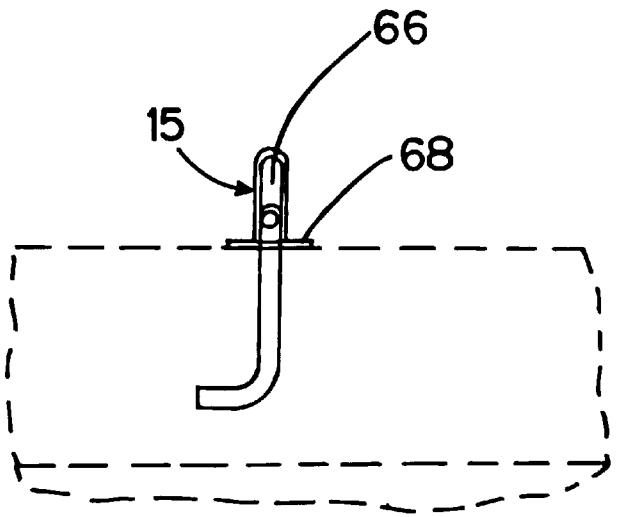
FIG. 17 is a side elevational view taken along line 17—17 of FIG. 16.

Referring now to FIGS. 16 and 17, the hanger 14 includes a bracket 15 which is formed by a bent plate 64 having an aperture 66 therethrough and which is mounted to a bearing plate 68 which bears on the upper portion 12*a* of the girder 12'. The bent plate 64 is welded or otherwise secured to a rod 69 which is embedded in the concrete girder 12'. A nut 65 is provided which engages the threaded rod 17 (viewable in fragment in FIG. 16) so that the frame section 16 may be drawn tightly against the support structure 12. Further, the adjustable connection 32 is accessible from above by virtue of cutouts provided in the panel 38 (discussed in detail below). Thus, the bracket 15 is connectable to the bracket 53, thereby permitting the frame 16 to be connected to the girder 12'.

Figure 8:
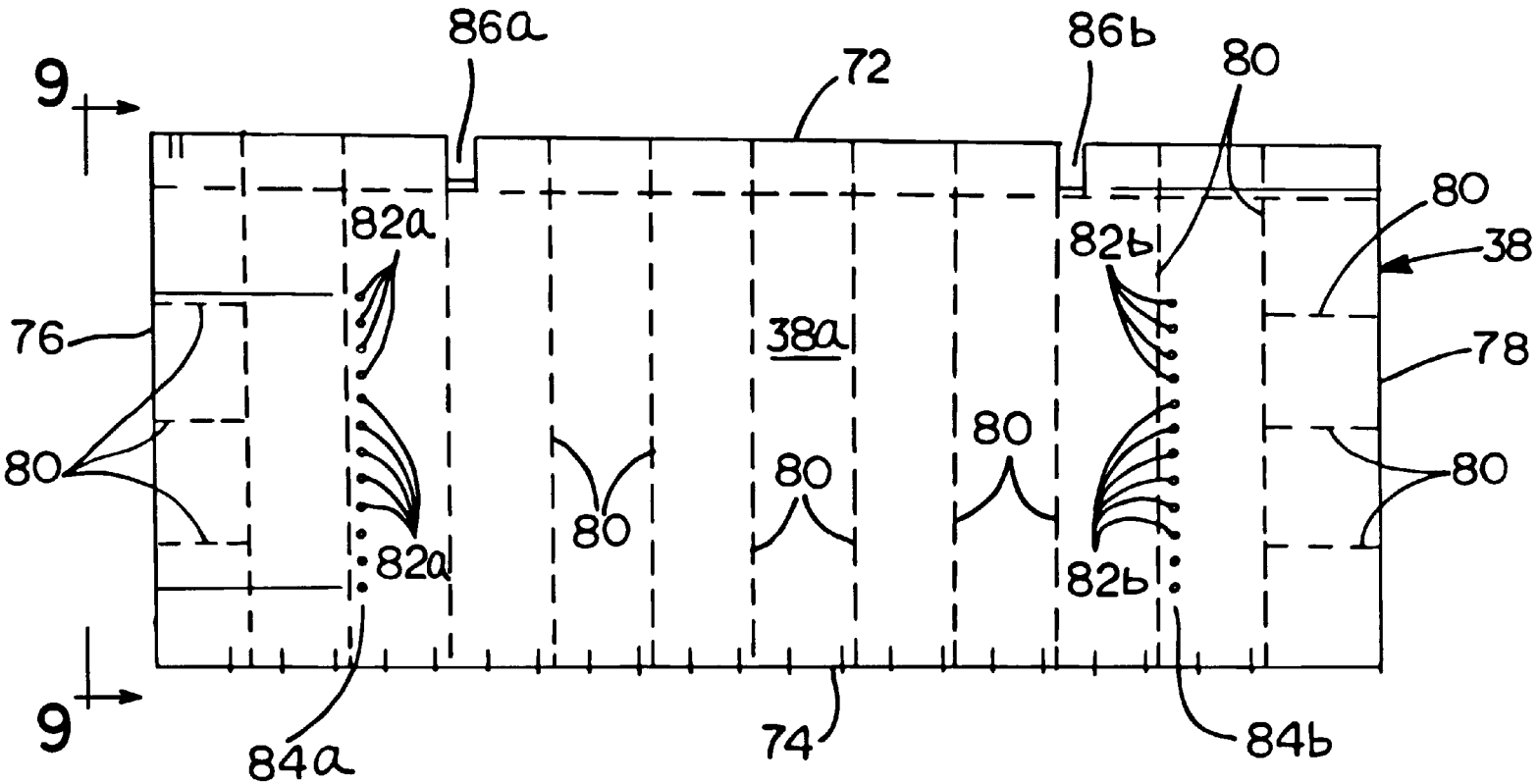
FIG. 8 is a plan view of a form panel for attachment between a pair of supporting frames.
Figure 9:
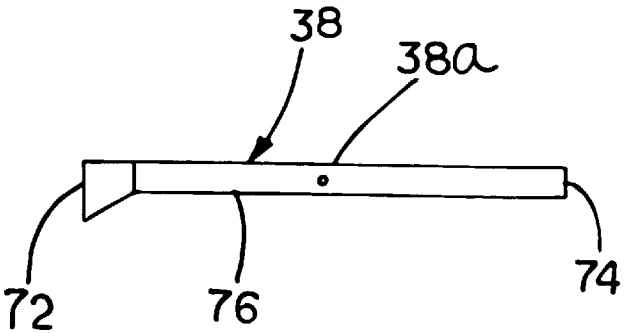
FIG. 9 is an end view taken along line 9—9 of FIG. 8.

Referring now to FIGS. 8 and 9, the panel 38 includes an inner edge 72, an outer edge 74, and ends 76 and 78. It will be noted that the end 76 generally overlies and is attached to the frame 16, while the end 78 generally overlies and is attached to the frame 16'. The panel 38 includes a plurality of stiffeners 80 which stiffen the surface 38*a*. The panel 38 further includes a plurality of attachment holes 82*a*, 82*b* arranged along two gage lines 84*a*, 84*b*. Preferably, threaded nuts (not shown) will be welded to the underside of the panel 38. A pair of clearance cutouts 86*a*, 86*b* are provided along the inner edge 72, which cutouts 86*a*, 86*b* provide a clearance passage for the threaded rod 17 as will be explained in greater detail below.

Figure 12:
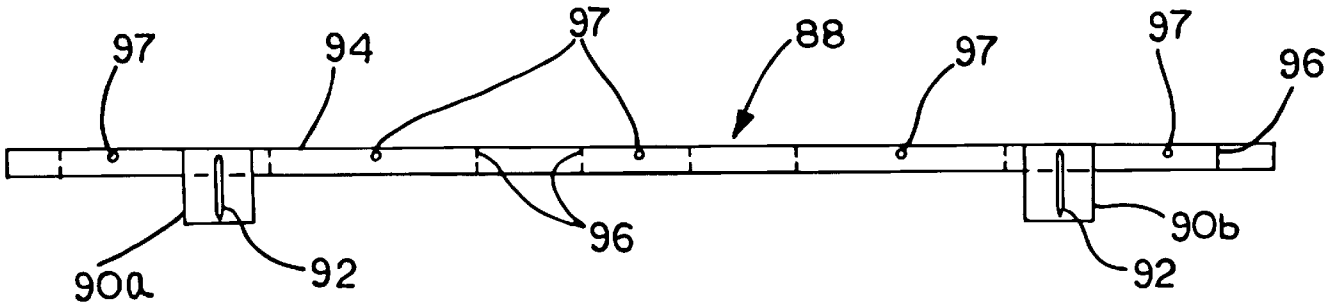
FIG. 12 is a bottom plan view of an edge form which is adapted for attachment to the form panel.
Figure 13:
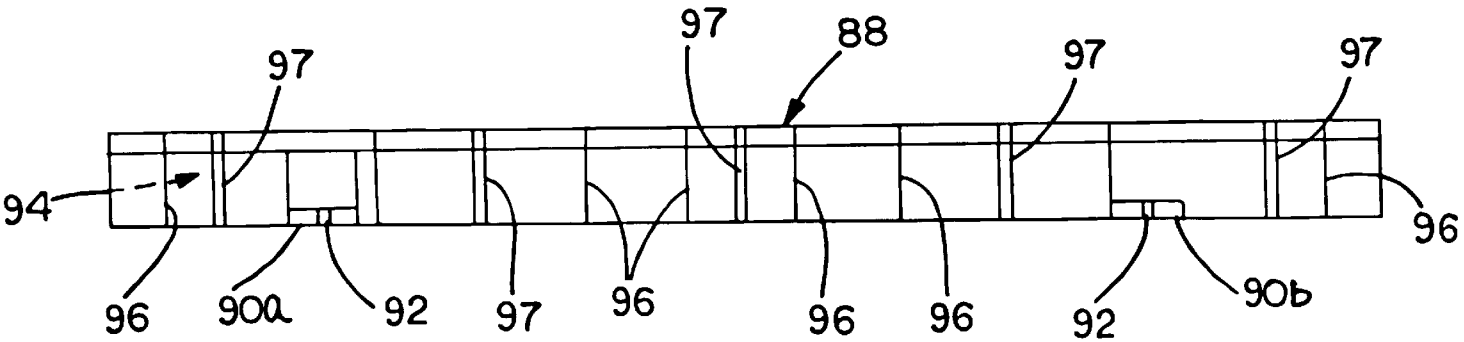
FIG. 13 is an elevational view thereof.

The attachment holes 82*a*, 82*b* permit the attachment of an edge form 88, which is shown in FIGS. 12 and 13. Referring to FIGS. 12 and 13, the edge form 88 includes a pair of attachment plates 90*a*, 90*b*, each of which includes a slotted attachment hole 92. It will be noted that the attachment plates 90*a*, 90*b* are spaced to correspond to the spacing between the gage lines 84*a*, 84*b* on the panel 38, thus permitting the edge form 88 to be secured to a selected pair of the attachment holes 82*a*, 82*b* on the panel 38, such as by using bolts through the threaded nuts (not shown) secured to the underside of the panel 38. It will be appreciated that the slotted holes 92 will permit fine adjustment of the position of the edge form 88, while the spacing between the attachment holes 82*a*, 82*b* permit larger adjustments. The edge form 88 will preferably include an inner plate 94, a number of vertically oriented stiffeners 96, and a plurality of one inch diameter pipe sections 97. In the disclosed embodiment, the pipe sections 97 are sized to receive a portion of the cradle assembly (discussed below), which in turn supports concrete finishing equipment (not shown). Plate stiffeners or other sections may be used for the stiffeners 96.

Figure 22B:
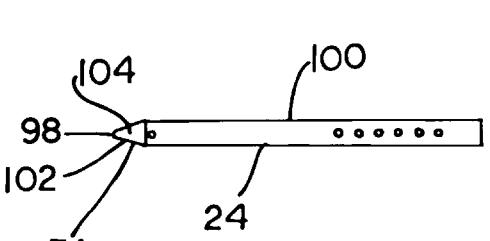
FIG. 22B is an enlarged fragmentary view elevational view of the inner end of the lower leg illustrated in FIG. 22A.
Figure 22A:
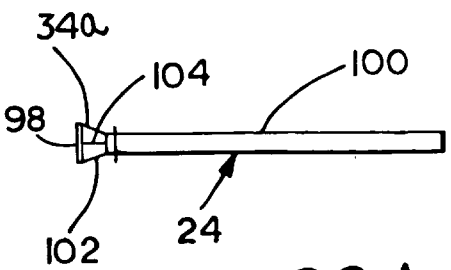
FIG. 22A is an enlarged fragmentary top plan view of the inner end of the lower leg of the frame sections illustrating the detail at the point of abutment between the frame sections and the bridge girder.

Referring now to FIGS. 22A and 22B, the inner end 34*a* of the diagonal leg 24 will preferably include an elongated bar 98 connected to the central portion 100 of the leg 24. As outlined above, the central portion 100 of the leg 24 is typically a tubular section, such as a 4"×3"×3/16" section. Other sizes may be employed based on design considerations as would be known. A bent plate 102 is connected to both the bar 98 and the central portion 100. A stiffener 104 may be provided. As shown in FIG. 22A, the bar may be longer than the lateral dimension of the central portion 100, such that the bar 98 will present an elongated surface for abutment with the lower portion 12*b* of the girder 12'.

Figure 23A:
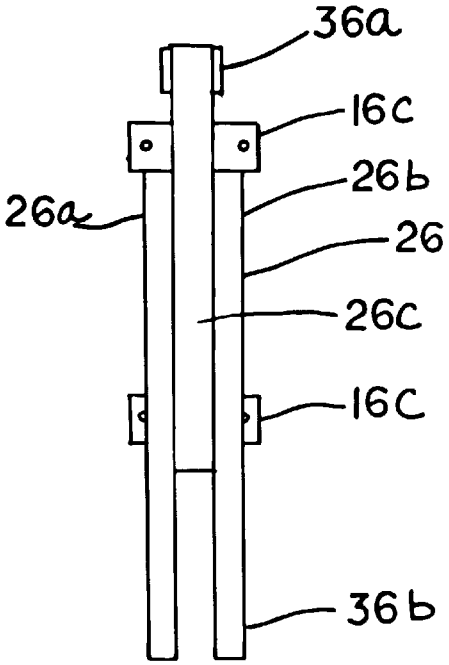
FIG. 23A is a fragmentary elevational view of a brace leg that braces the upper leg and the lower leg of the frame sections.
Figure 23B:
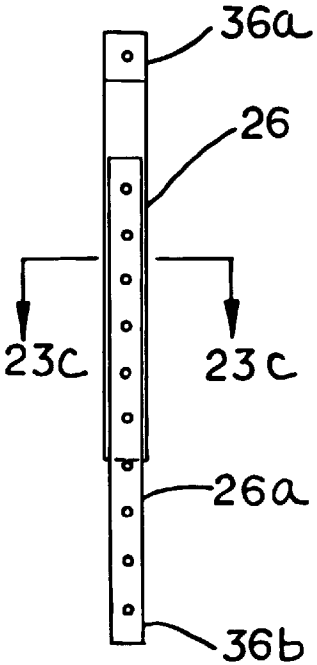
FIG. 23B is a side elevational view thereof.
Figure 23C:
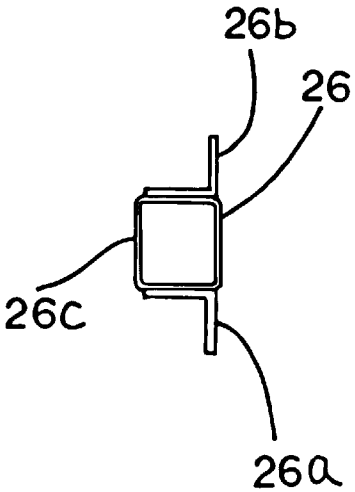
FIG. 23C is a cross-sectional view taken along line 23C—23C of FIG. 23B.

Referring now to FIGS. 23A, 23B and 23C, the brace leg 26 may alternatively be constructed of a pair of L-shaped sections 26*a*, 26*b*, which are attached along the sides of a tubular section 26*c* using a plurality of attachment bolts in a plurality of attachment holes. The L-shaped sections 26*a* and 26*b* may be attached at any one of a plurality of possible positions relative to the section 26*c*. This construction offers additional flexibility in adjusting the length of the brace leg 26, thus making connection of the end 36*b* of the brace leg 26 to the desired point on the diagonal leg 24 easier.

Figure 21:
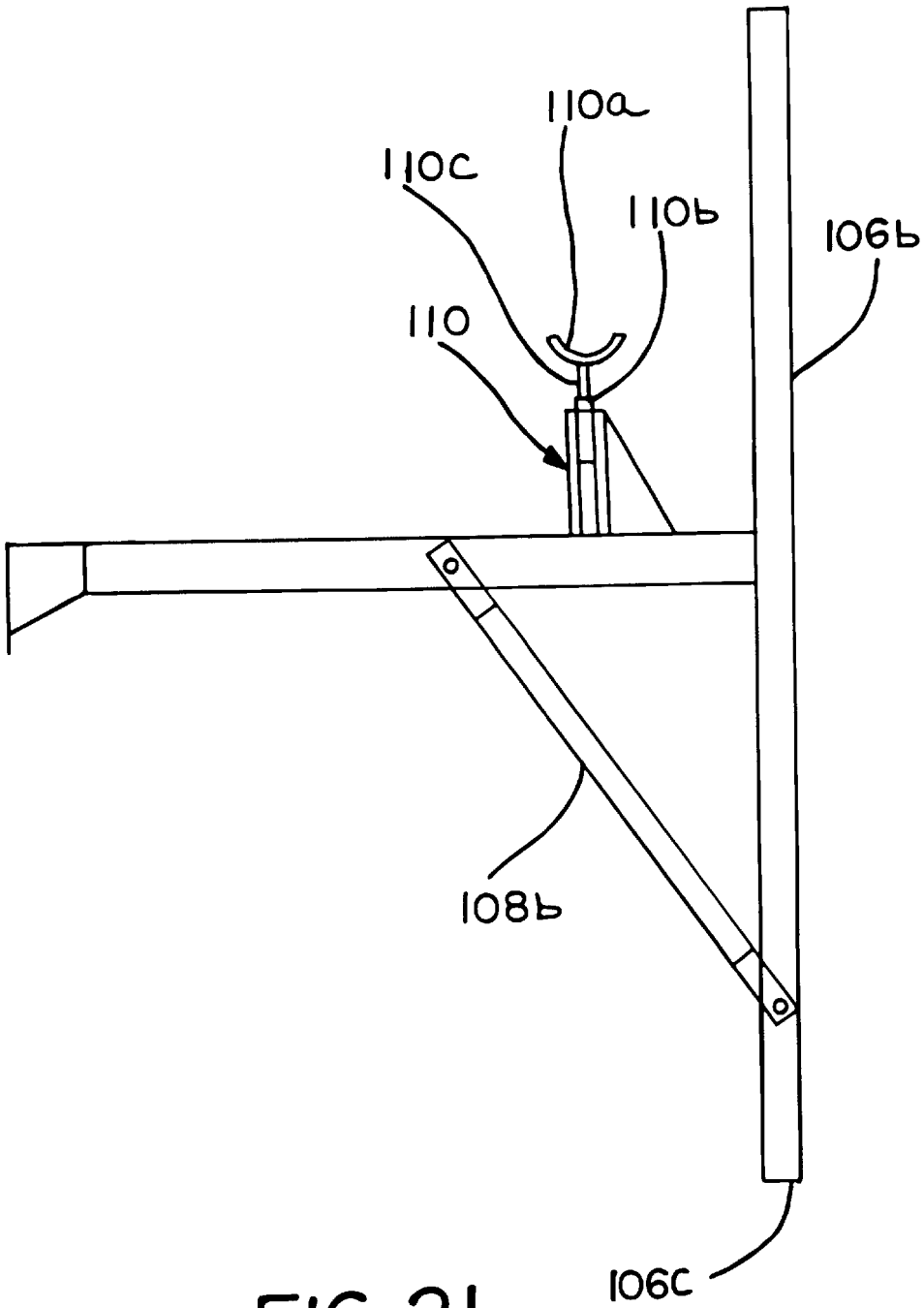
FIG. 21 is a fragmentary end elevational view illustrating guardrail bracing.

Referring now to FIGS. 15, 20 and 21, a number of posts 106*a*, 106*b* may be secured to the outer edge 74 of the panel 38 using a plurality of bolts 107*a* in selected ones of a plurality attachment holes 107*b* in the outer edge 74 of the panel 38. The posts 106*a* and 106*b* may be used to support guard rails (not shown). The posts 106*b* extend downwardly below the plane of the panel 38. It will be noted that one or more braces 108*a* (FIG. 15) and 108*b* (FIG. 21) may be provided in order to brace the posts 106*b* against rotation about two different axes. Each of the posts 106*b* includes a lower end 106*c*.

Figure 24:
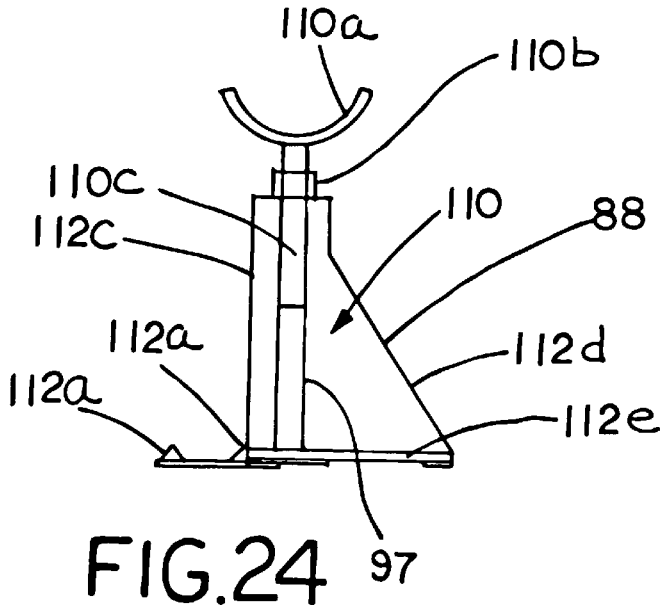
FIG. 24 is an enlarged fragmentary elevational view of an edge form with an attached cradle assembly.
Figure 25:
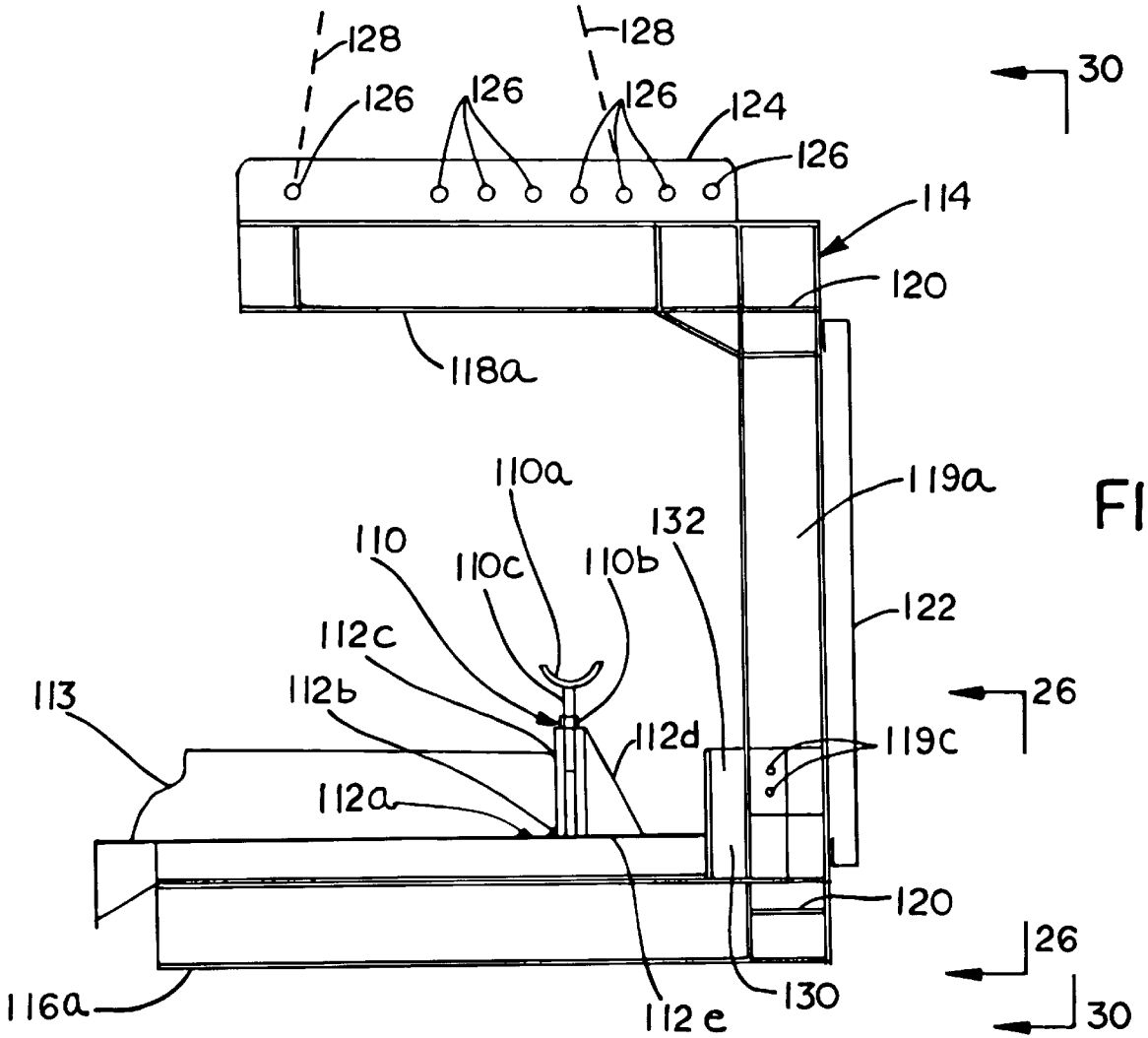
FIG. 25 is a fragmentary elevational view of a crane supported "C" hook engaging a section of an overhanging form section of the present invention.
Figure 28:
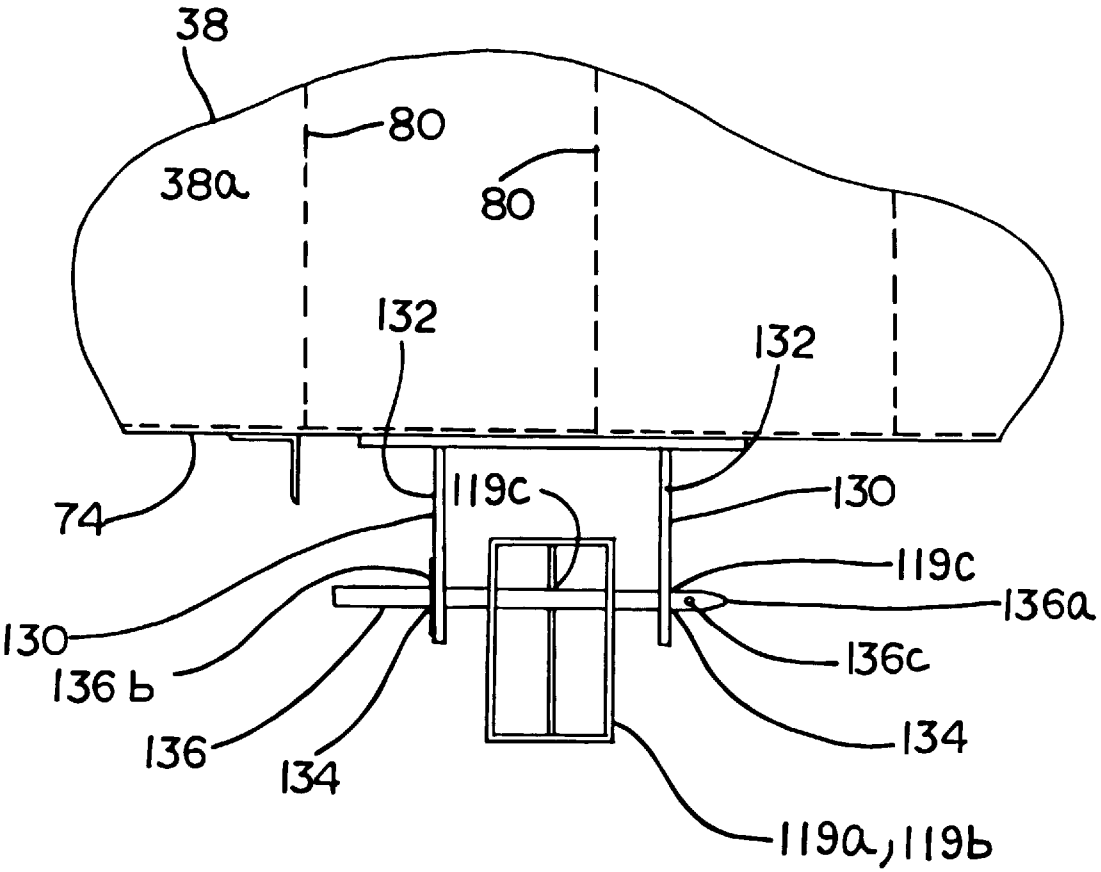
FIG. 28 is an enlarged fragmentary top plan view illustrating a portion of the assembly for attaching the "C" hook to the form section.
Figure 29:
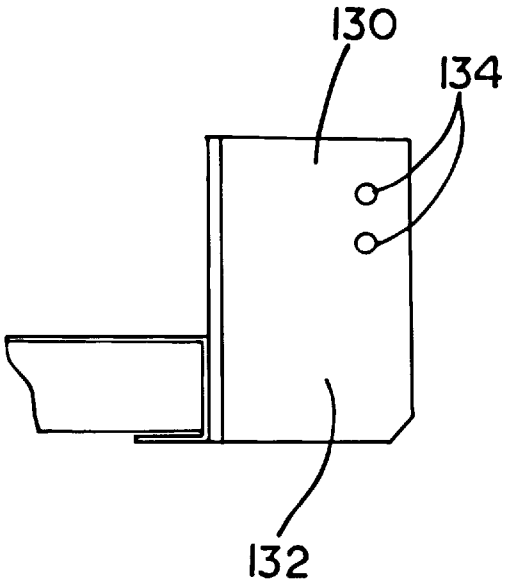
FIG. 29 is an enlarged fragmentary view taken about the circumscribed portion of FIG. 25 and illustrating the attachment member attached to an outer portion of the frame section.

Referring now to FIGS. 21, 24 and 25, a cradle assembly 110 may be secured to the edge form 88 at the desired locations. It will be understood that additional cradle assemblies 110 (not shown) are attached to the edge form 88 at intervals selected by the user. The cradle assembly 110 includes a cradle head 110*a* which is vertically adjustable using an adjustment nut 110*b* which engages a threaded rod 110*c*. One or more chamfer strips 112*a*, 112*b* and 112*c* are provided which may be attached to the edge form 88 and which extend generally parallel to the edge form 88. At least one of the chamfer strips, for example the chamfer strip 112*a*, may be placed loosely upon the panel 38. The chamfer strips 112*a*, 112*b* and 112*c* may function to form chamfered edges or indentations on the concrete section 113 (shown in fragment in FIG. 25) to be poured. One or more stiffener plates 112*d* extending to a base plate 112*e* may also be provided. As would be known, the cradle assembly 110 is used to support concrete finishing equipment that rolls along a rail (not shown) extending between adjacent cradle assemblies 110.

Figure 30:
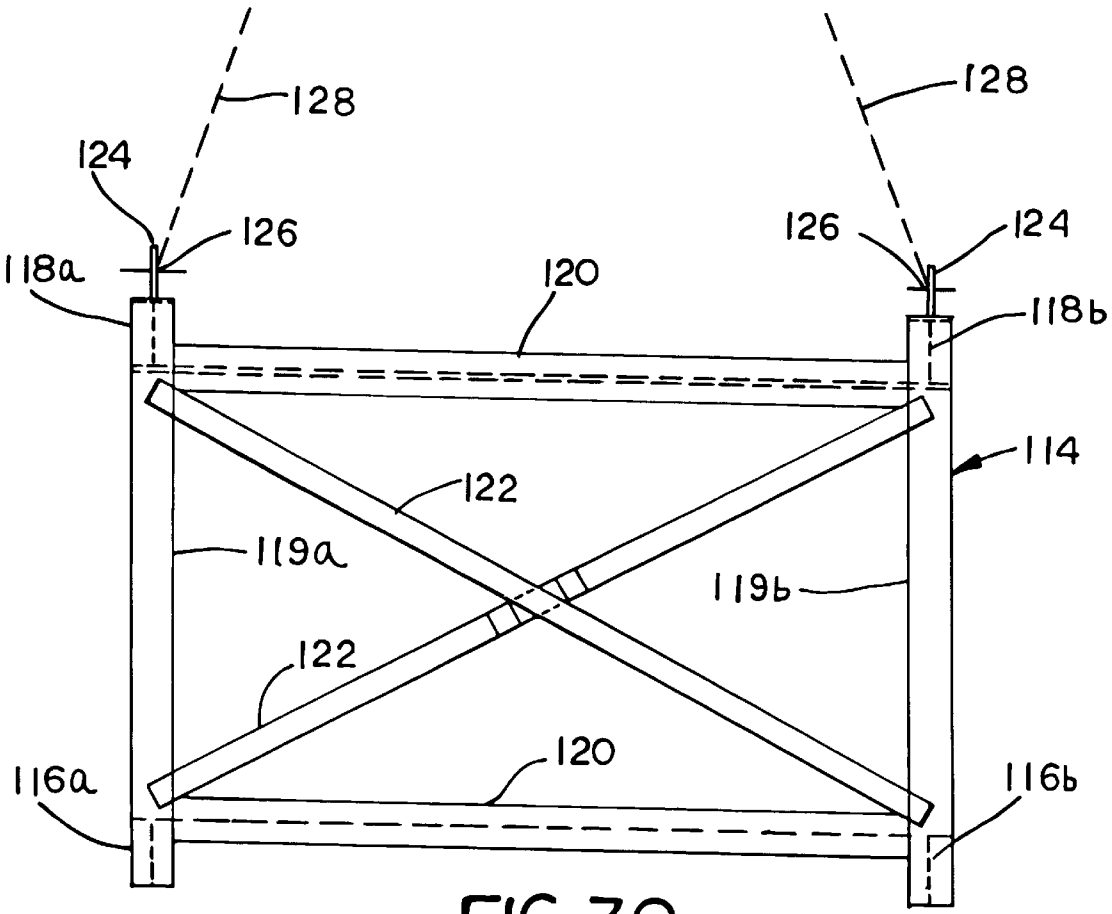
FIG. 30 is an elevational view taken along line 30—30 of FIG. 25 and illustrating further details of the "C" hook.
Figure 31:
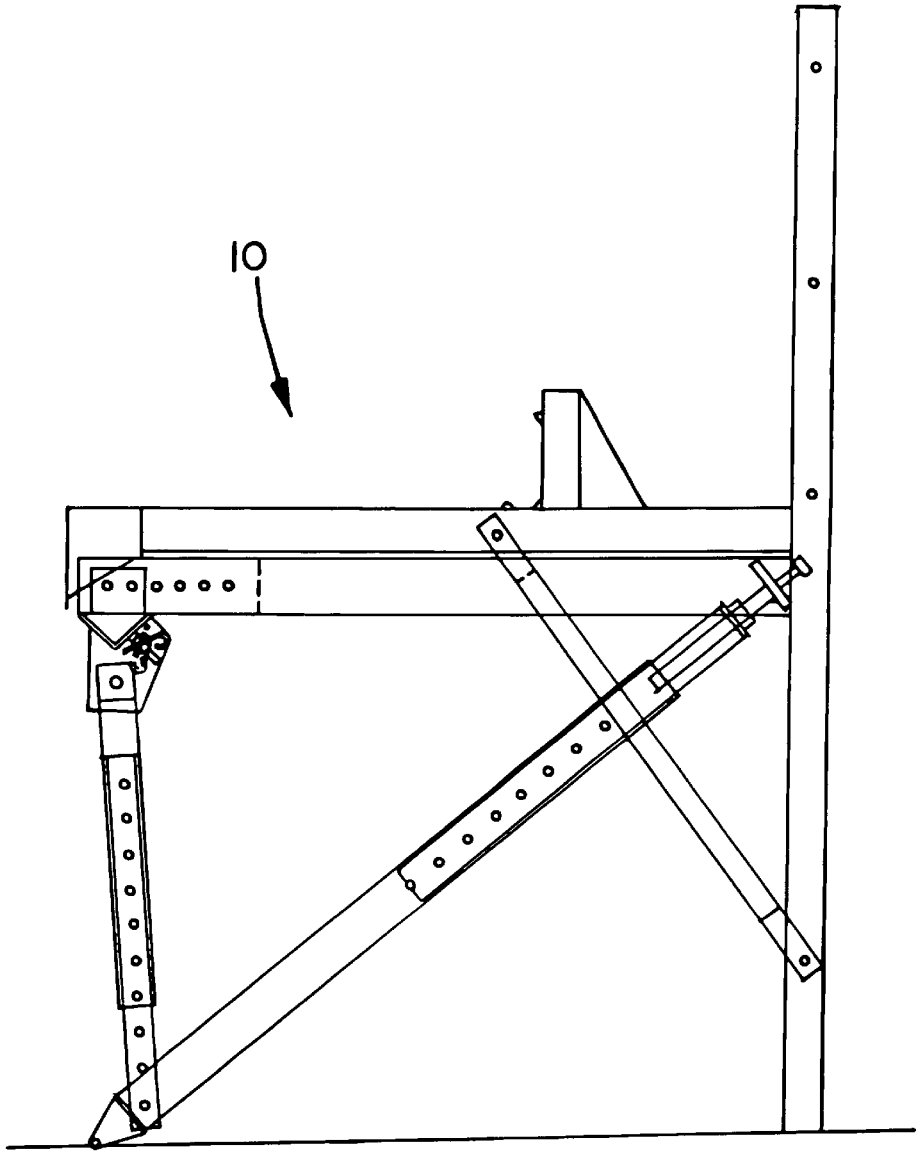
FIG. 31 is an end elevational view of a fully assembled form section which is standing in a stable configuration on the ground without any external support or bracing means.

Referring now to FIGS. 25, 30 and 31, a "C" hook assembly 114 may be used to pick up one section 10' of the overhanging form system 10 from a ground assembly station (for example, as shown in FIG. 31), and place the form section 10' adjacent to the girder 12' for connection to the hangers 14, 14'. In a similar manner, the "C" hook assembly 114 may be used to strip the section 10' off the support structure 12 after the poured concrete has sufficiently cured, and again place the form section 10' on the ground as shown in FIG. 31. The "C" hook assembly 114 includes a pair of bottom legs 116*a*, 116*b*, a pair of top legs 118*a*, 118*b*, a pair of vertical legs 119*a*, 119*b*, and a plurality of interconnecting members 120 and braces 122. The vertical legs 119*a*, 119*b* will include holes 119*c* (FIG. 25). Attachment plates 124 are provided on each of the top legs 118*a*, 118*b*, with each of the attachment plates 124 having a plurality of holes 126, thus enabling the "C" hook assembly 114 to be lifted by a crane (not shown) using suitable rigging 128.

Figure 27:
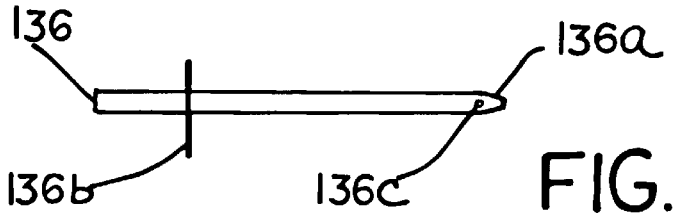
FIG. 27 is an elevational view of a drift pin for use with the assembly for attaching the "C" hook to the form section.
Figure 26:
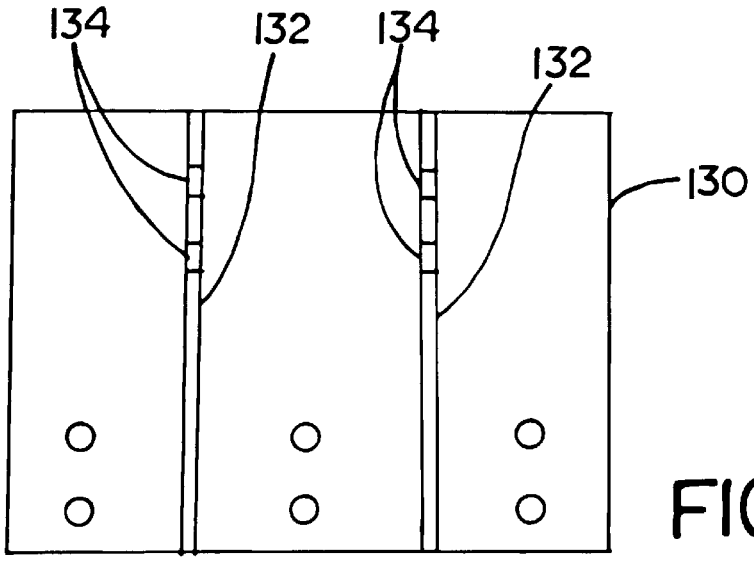
FIG. 26 is an enlarged fragmentary elevational view taken along line 26—26 of FIG. 25 and illustrating an attachment member for use in attaching the "C" hook to the form section.

Referring to FIGS. 25, 26, 28 and 29, a pair of mounting brackets 130 are mounted to the outer edge 74 of the panel 38 by a plurality of suitable fasteners 131. The mounting brackets 130 are spaced to match the spacing of the vertical legs 119*a*, 119*b* and may be used to secure the "C" hook assembly 114 to the form section to be lifted. Each of the mounting brackets 130 includes a pair of spaced apart plates 132, each of which includes a pair of holes 134. Using a pair of pins 136 (FIGS. 27 and 28), the "C" hook assembly 114 is connectable to the mounting brackets 130 by inserting pins 136 through the holes 134 in the plates 132 of the mounting brackets 130 and through the holes 119*c* in each of the vertical legs 119*a*, 119*b*. Each of the pins will preferably include a tapered end 136*a*, an enlarged flange 136*b*, and a hole 136*c* for receiving a cotter pin (not shown) to maintain the pin 136 in place.

In operation, one form section 10' of the overhanging form system 10 is assembled by connecting the legs 22, 24 and 26 to each other as shown in FIG. 1 to create the frame 16. Again, it will be understood that the frame 16' is assembled in a similar manner. The length of each of the legs 22, 24, and 26 will be varied depending on the dimensions of the particular application. The length of the legs 24 and 26 may be telescoped in the disclosed embodiment. Further, the adjustable connection 40 at the outer ends 30*b*, 34*b* of the legs 22, 24, respectively, is assembled as outlined above.

The panel 38 is connected to the upper leg 22 of each of the frames 16, 16'. The distance between the frames 16, 16' will vary depending on the particular application, as will the length of the interconnecting panel 38. Preferably, the form section 10' will be assembled at an assembly location which is removed from the support structure 12, such as, for example, on the ground (as shown in FIG. 31). As shown in FIGS. 14 and 15, the stiffeners 28*a* and 28*b* are secured to both of the frame 16 and the frame 16'. The posts 106*a*, 106*b* are secured to the outer edge 74 of the panel 38 using the bolts 107*a* in the attachment holes 107*b* at the outer edge 74 of the panel 38. Again, guard rails (not shown) may also be attached. The braces 108*a* (FIG. 15) and 108*b* (FIG. 21) are attached to brace the posts 106*b*. The lower end 106*c* of each of the posts 106*b* may cooperate with the ends 36*b* of the legs 24 on each of the frames 16, 16' such that the resulting form section 10' may stand unsupported on the ground (FIG. 31). The edge form 88 and the cradle assemblies 110 are secured at the appropriate locations as outlined above.

When the overhanging form system 10 is used in conjunction with the concrete bridge girder 12', a plurality of the embedded rods 69 will preferably already be in place on the girder 12', spaced at the appropriate intervals. Consequently, the hangers 14, 14' and the brackets 15, 15' (FIGS. 16 and 17) will already be in place on the girder 12'.

The form section 10' is placed by securing the "C" hook assembly 114 to the form section 10' as outlined above using the pins 136 inserted through the appropriate holes 134 in the mounting bracket 130 and the holes 119*c* in the legs 119*a*, 119*b*. Using the rigging 128, the form section 10' may be lifted using a conventional crane or other lifting device (not shown).

Once the form section 10' is lifted to a position adjacent to the girder 12', the adjustable connection 32 is used to connect the bracket 53 to the bracket 15, thus securing the frames 16, 16' to their respective hangers 14, 14'. When the section 10' is lifted into place, the rod 17 is fed through the aperture 66 in the bent plate 64, preferably from above. The cutouts 86*a*, 86*b* in the panel 38 provide clearance for the threaded rods 17. Each rod 17 extends through the elongated hole 61 in the cross member 55 and engages the tapped hole 63 in the rod 58. Rotation of the rod 58 about its longitudinal axis within the apertures 59 accounts for angular variations. Further, the elongated hole 61 in the cross member 55, along with the play permitted by the keeper pins 60, account for slight longitudinal misalignments. Adjustment of the frame section 16 relative to the upper portion 12*a* of the girder 12' is accomplished by rotating the nut 65 that engages the rod 17, thus drawing the frame section 16 toward or away from the hanger 14 depending on the direction of rotation of the nut 65. Alternatively, the adjustment of the frame section 16 may also be accomplished by rotating the entire rod 17 using a wrench attached to the hex heads at the ends 17*a* or 17*b*. Either way, adjustment of the connection 32 is effectuated.

As outlined above, the elevation of the outer end 30*b* of the upper leg 22 may be accomplished using the adjustable connection 40 (FIG. 4) at the intersection of the upper leg 22 and the diagonal leg 24 as discussed in detail above. Preferably, the threaded rod 17 will be encased in a suitable sleeve 138 (indicated by dotted lines in FIG. 1). Accordingly, subsequent to the concrete pour, the threaded rod 17 may be removed from above (or below) using a suitable tool engaging the hex head at the and 17*a*. The remaining hole may be filled by grout or other suitable material.

Figure 7:
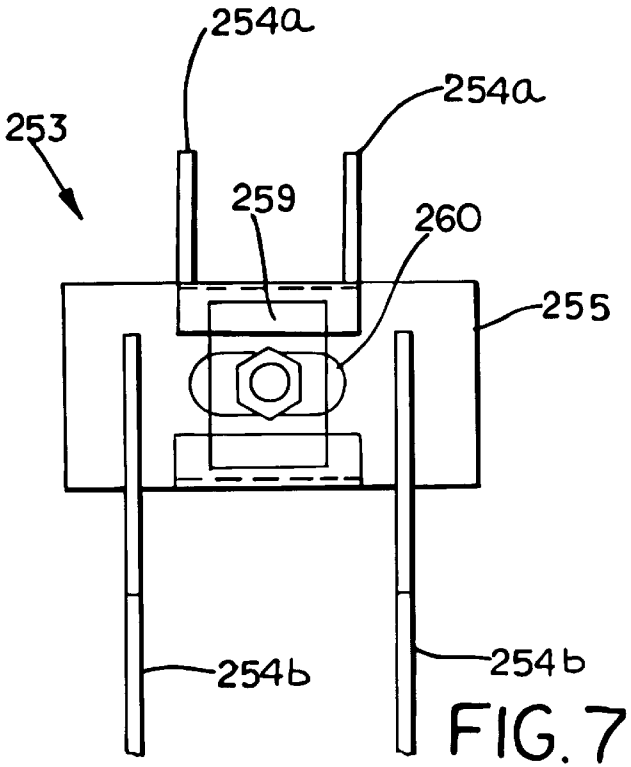
FIG. 7 is an elevational view taken along line 7—7 of FIG. 6.
Figure 6:
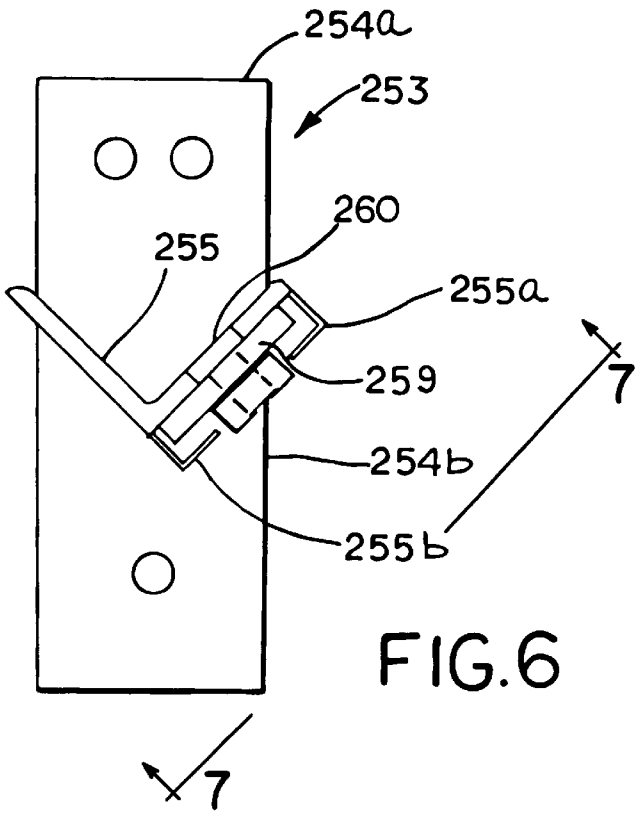
FIG. 6 is an enlarged elevational view of an alternative form for the adjustable connection shown in FIG. 2.

Referring now to FIGS. 6 and 7, an alternate embodiment for a bracket used in the adjustable connection 32 is shown which is referred to by the reference numeral 253, and which may be substituted for the bracket 53 shown in FIGS. 2 and 3 in order to secure the frame 16 to the hanger 14. The bracket 253 includes a cross member 255. A pair of upper plates 254*a* and a pair of lower plates 254*b* are mounted to the cross member 255. As shown in FIG. 6, the cross member 255 includes pair of angled capture plates 255*a*, 255*b* and an elongated hole 260. A threaded plate 259, which may be a plate with a nut welded thereon, is loosely disposed between the capture plates 255*a*, 255*b* and the cross member 255. As shown in FIG. 7, the lower plates 254*b* prevent the plate 259 from sliding out past the ends of the capture plates 255*a*, 255*b*. Also viewing FIG. 7, it will be noted that the plate 259 is moveable left to right (i.e., in a direction parallel to an axis of the girder 12') in a direction parallel to the elongated hole 260. The threaded rod 17 discussed above with respect to the first embodiment engages the threaded plate 259, so that the bracket 253 may be connected to the bracket 15 in a manner similar to that outlined above with respect to FIGS. 2 and 3.

Figure 18:
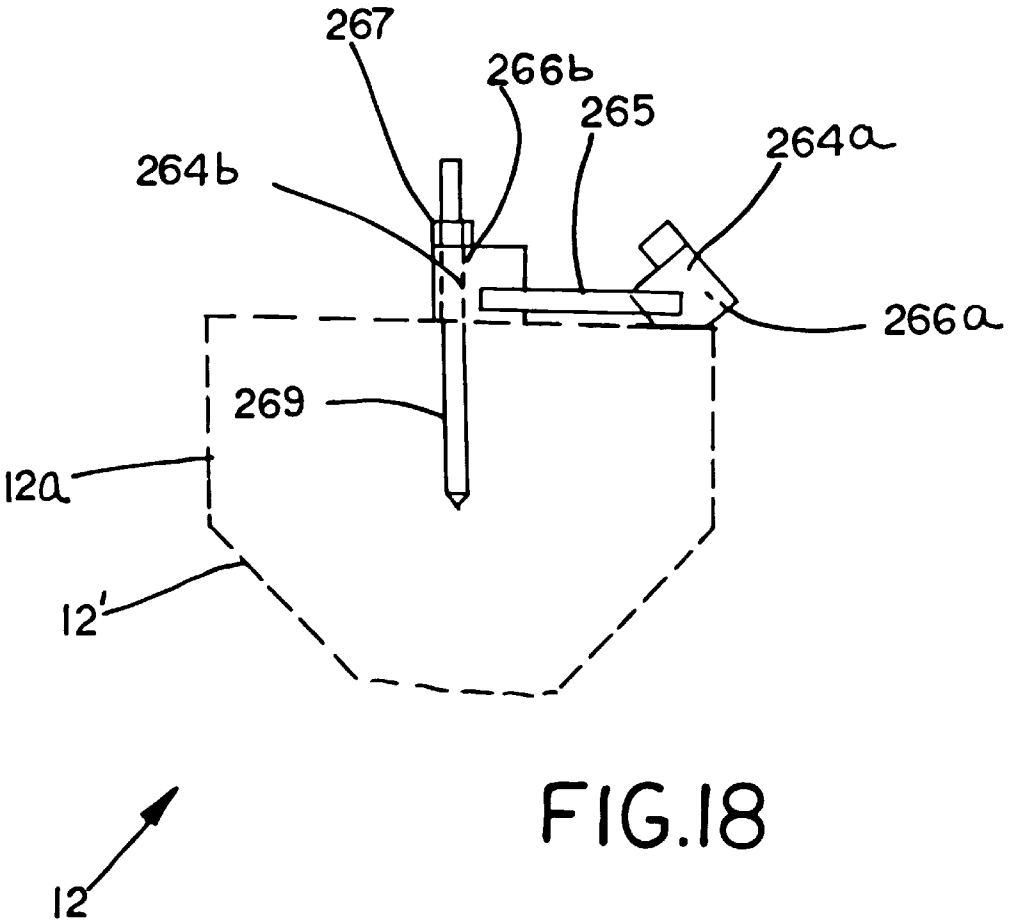
FIG. 18 is an enlarged fragmentary elevational view similar to FIG. 16 but illustrating an alternative detail for attachment to the concrete bridge girder.

Referring now to FIG. 18, an alternate form for the hanger and the bracket are shown which are referred to by the reference numerals 214 and 215, respectively. The hanger 214 and the bracket 215 may be used when the embedded rod 69 shown in FIGS. 1, 16 and 17 is either missing, or has been misplaced longitudinally along the girder 12'. The bracket 215 includes a pair of bent plates 264*a* and 264*b*, each of which defines a through hole 266*a*, 266*b*. The bent plates 264*a* and 264*b* are connected by a rod 265. A threaded rod 269 may be embedded in the upper portion 12*a* of the girder 12' by drilling a hole at the needed location and grouting the rod 269 in place. The bent plate 264*a* is secured to the grouted in place rod 269 using a threaded nut 267. The threaded rod 17 (not shown in FIG. 18) is then connected to the bracket 53 attached to the appropriate frame section 16 and adjusted as necessary in the manner described above with respect to the first described embodiment.

Referring now to FIGS. 10, 11 and 19, the overhanging form system 10 in accordance with the present invention is also useable with other forms of support structure 12, such as a steel "I" beam or wide flange girder 12" (FIGS. 10 and 19) or another concrete girder 12'" (FIG. 11). In such applications, certain details of the hangers and brackets are modified. In the embodiment shown in FIGS. 10 and 19, a hanger 214 includes a bracket 215 which is formed by a bent plate 264 having an aperture 266 therethrough and which is connected by a rod 270 to a J-shaped bracket 269 which engages the top flange 212*a* of the girder 12". The J-shaped bracket 269 can be secured at a desired location along the girder 12" simply by hooking the J-shaped bracket over the top flange of the girder 12". Alternatively, referring to FIG. 11, the J-shaped bracket 269 may include a bolt 271*a* and a threaded nut 271*b*, with the J-shaped bracket 269 being secured to the top flange of the girder 12" by tightening the nut 271*b*. Either way may be used to secure the hanger 14 to the support structure 12 by inserting the rod 17 through the aperture 266 and into the bracket 53 (discussed above with respect to the first described embodiment), thereby permitting the frame 16 of the frame section 10' to be connected to the girder 12".

In the embodiment shown in FIG. 11, the relative lengths and angles of the legs 22, 24, and 26 are adjusted such that the top leg 22 (and the attached panel 38) are disposed at the proper elevation and angle.

It will further be appreciated that in accordance with the disclosed embodiment numerous form sections may be secured to the support structure adjacent to each other to form a generally continuous overhanging form system. The adjacent sections need not be connected to each other, and thus each form section, including all desired attached components such as edge forms, guard rails, etc., may be set and stripped with a minimum of labor.

The aforementioned hanger details may be substituted for each other. For example, on certain jobs it may be desired to attach the hangers to cast in place embedded rods, while in other applications it may be desirable to drill and grout the rods individually. Similarly, the J-shaped brackets 269 of FIGS. 10 and 19 are interchangeable as desired.

In accordance with the disclosed embodiment, it will be noted that the overhanging form system 10 may be assembled, placed on the girder, and removed from the girder all without requiring personnel to work underneath the form system. Because the adjustable connections 32 are easy to align and are accessible from above, each of the remotely assembled form sections may be secured to the appropriate hangers on the girder without requiring personnel to work underneath a partially secured form section. The safety offered by such a system is especially evident on high bridges and other structures. Further, safety features such as guardrail posts, handrails, and toeboards may be secured to the sections and left in place throughout the job, with no need to repeatedly assemble and disassemble such items.

Those skilled in the art will appreciate that, although the teachings of the invention have been illustrated in connection with certain embodiments, there is no intent to limit the invention to such embodiments. On the contrary, the intention of this application is to cover all modifications and embodiments fairly falling within the scope of the appended claims either literally or under the doctrine of equivalents.

What is claimed:

1. An overhanging form system for attachment to a support structure, the support structure having an upper portion and a lower portion, the overhanging form system comprising:

a pair of spaced apart hangers, each of the hangers being adapted to engage the upper portion of the support structure;

a pair of frames, each of the frames having a first portion and a second portion, the first portion engaging a corresponding one of the hangers, the second portion being adapted to engage the lower portion of the support structure, each of the frames further having a first leg and a second leg, the first leg having an inner end disposed adjacent the first portion of the frame and an outer end disposed outwardly from the first portion of the frame, the second leg extending from the second portion of the frame to engage the outer end of the first leg; and a plurality of stiffeners extending between the pair of frames;

whereby the overhanging form system may lifted as a single unit and attached to the support structure in cantilevered fashion.

2. The overhanging form system of claim 1, including a panel extending between the pair of frames, the panel including a support surface adapted to support poured concrete.

3. The overhanging form system of claim 1, wherein each of the hangers comprises a first bracket secured to the inner end of the first leg, a second bracket secured to the upper portion of the support structure, and a threaded rod adjustably connecting the first bracket to the second bracket.

4. The overhanging form system of claim 3, wherein at least one of the first bracket and the second bracket includes a rod receiving slot extending generally parallel to the longitudinal axis of the support structure, the slot permitting longitudinal adjustment of the first and second frames relative to the hangers.

5. The overhanging form system of claim 3, wherein the support structure includes a longitudinal axis, and including adjustment means for adjusting the longitudinal position of the frames relative to the hangers.

6. The overhanging form system of claim 1, wherein each of the hangers comprises an adjustable connection, the adjustable connection including a first bracket, a second bracket, and a threaded rod connecting the first bracket and the second bracket, the first bracket joined to the first portion of the adjacent frame, the second bracket secured to an upper portion of the support structure.

7. The overhanging form system of claim 1, wherein each of the frames includes a brace engaging the first leg and the second leg, the brace fixing the position of the first leg relative to the second leg.

8. The overhanging form system of claim 7, wherein the brace comprises a third leg extending between the first leg and the second leg.

9. The overhanging form system of claim 8, wherein the third leg includes an upper end and a lower end, the upper end secured to the first leg adjacent the first portion of the frame, the lower end secured to the second leg adjacent the second portion of the frame.

10. The overhanging form system of claim 1, wherein at least one of the first leg and the second leg is adjustable in length.

11. The overhanging form system of claim 1, including an adjustable connection between the outer end of the first leg and the second leg.

12. The overhanging form system of claim 2, including an edge form attached to the panel.

13. The overhanging form system of claim 12, wherein the panel includes a first attachment line and a second attachment line, and wherein the edge form is secured to at least one of the attachment lines.

14. The overhanging form system of claim 13, wherein the first attachment line is disposed a first distance from the first portion of each of the frames, and further wherein the attachment line is disposed a second distance from the first portion of each of the frames.

15. The overhanging form system of claim 1, including cross bracing extending between the pair of frames.

16. An overhanging form system for attachment to a support structure, the support structure having an upper portion, a lower portion, and defining a longitudinal axis, the overhanging form system comprising:

a pair of spaced apart frames, each of the frames having:

a top leg, the top leg of each of the frames having an inner end and an outer end, the inner end adapted for securement to the upper portion of the support structure;

a lower leg, the lower leg of each of the frames having an inner end and an outer end, the inner end adapted to releasably abut the lower portion of the support structure, the outer end being joined to the outer end of the top leg; and a brace engaging the top leg and the lower leg, the brace fixing the position of the top leg relative to the lower leg; and a pair of cross braces extending between the pair of frames.

17. The form system of claim 16, including a panel extending between the frames.

18. The form system of claim 17, wherein the panel includes a first attachment line and a second attachment line, and wherein the edge form is secured to at least one of the attachment lines.

19. The form system of claim 18, wherein each of the top and lower legs is adjustable in length.

20. The form system of claim 16, in combination with a support structure, and including a pair of spaced apart hangers mounted to the support structure, each of the hangers releasably engaging the inner end of the top leg on each of the frames, thereby permitting the form system to be releasably mounted to the support structure in cantilever fashion.

21. The form system of claim 20, wherein an adjustable connection includes a first bracket secured to the inner end of the top leg and a second bracket secured to an upper portion of the support structure, and wherein the first bracket and the second bracket are adjustably connected by a threaded rod, and further wherein at least one of the first bracket and the second bracket includes a rod receiving slot extending generally parallel to a longitudinal axis of the support structure, the slot permitting longitudinal adjustment of the spaced apart frames relative to the hangers.

22. An overhanging form system for use on a support structure having an upper portion, a lower portion, and defining a longitudinal axis, the system comprising:

a pair of spaced apart hangers secured to the upper portion of the support structure at a first interval relative to the longitudinal axis;

a pair of frames, each of the frames having an inner portion disposed generally adjacent to the support structure and an outer portion disposed away from the support structure, each of the frames further including an upper leg and a lower leg, the lower leg having an inner end abutting the structure and an outer end joined to an outer end of the upper leg, the inner portion having an upper part and a lower part;

a concrete supporting form panel extending between the pair of frames; and an adjustable connection joining the inner portion of each of the frames to a corresponding one of the hangers, each adjustable connection comprising a first threaded rod and a tapped member, the first threaded rod extending between the corresponding hanger and the tapped member, the tapped member mounted to the frame so that the tapped member is rotatable about a rotation axis generally parallel to the longitudinal axis of the support structure, the tapped member further adjustable relative to the frame in a direction parallel to the longitudinal axis of the support structure, and further wherein the outer end of the lower leg is adjustably joined to the outer end of the upper leg by virtue of a second threaded rod engaging the upper leg and bearing on a shoulder on the lower leg to thereby permit lengthwise adjustment of the lower leg.

23. The overhanging form system according to claim 22 wherein the rotation axis of the tapped member intersects the first threaded rod.

24. The overhanging form system according to claim 22 wherein the tapped member is supported by a pair of spaced part plates, each of the plates having an aperture sized to receive the tapped member.

25. The overhanging form system according to claim 24 wherein the tapped member is a cylindrical rod having a tapped bore, the cylindrical rod having a pair of ends, each end sized to be received in the aperture of a corresponding one of the spaced apart plates.

26. The overhanging form system according to claim 25 wherein the cylindrical rod includes a pair of retention pins.

27. The overhanging form system according to claim 22 wherein at least one end of the first threaded rod includes a hex head, and wherein the first threaded rod is disposed in a sleeve, whereby the first threaded rod may be upwardly withdrawn after concrete is poured on the form panel.

28. The overhanging form system according to claim 22 wherein the form panel includes a first attachment line and a second attachment line, the first and second attachment lines extending generally parallel to the longitudinal axis of the support structure, and including an edge form for securement to at least one of the attachment lines.

29. The overhanging form system according to claim 22 including at least one cross brace extending between the pair of frames, and wherein each of the frames includes a stiffening brace engaging the upper leg and the lower leg.

30. The overhanging form system according to claim 22 wherein each of the frames includes a post secured adjacent the outer portion, each post having an upper portion arranged to receive a guard rail extending generally parallel to the longitudinal axis of the support structure and further having a lower portion, the lower portion of the post cooperating with the lower part of the inner portion of the frame to support the pair of frames on the ground when the adjustable connection is released, thereby permitting placement of the form system on the ground.

31. The overhanging form system according to claim 22 including a mounting bracket mounted to the outer portion of the frames, the mounting bracket including a pair of spaced apart plates having a plurality of apertures sized to receive a pin, the mounting bracket permitting the form system to be engaged by a "C" hook.

32. The overhanging form system according to claim 22 including a pair of aligned cradle assemblies secured to an outer portion of the form panel, and including at least one chamfer strip extending between the cradle assemblies.

33. A method of assembling an overhanging form section at a first location for subsequent attachment to a support structure at a second location, the method comprising the steps of:

providing a pair of frames, each of the frames having a first leg and a second leg, the first leg including an inner end and an outer end, the second leg including an inner end and an outer end, the inner end of the second leg adapted to abut a lower portion of the support structure;

adjusting the length of the first and second legs;

joining the outer end of the first leg to the outer end of the second leg;

spacing the frames apart a desired distance;

providing at least one cross brace between the frames; and securing a panel between the frames to create a form section, the panel having a surface adapted to define at least a portion of a concrete form.

34. The method of claim 33, including the steps of providing a pair of hangers, securing the hangers to the support structure spaced apart by a distance generally equal to the desired distance, lifting the form section to the second location to a position adjacent the support structure, and securing the inner end of each of the first and second legs to an adjacent one of the hangers.

35. The method of claim 33, including the steps of providing a pair of attachment lines on the panel, and securing an edge form to at least one of the attachment lines.

* * * * *